US011233344B2

(12) United States Patent
Hartmann

(10) Patent No.: US 11,233,344 B2
(45) **Date of Patent: *Jan. 25, 2022**

(54) CONDUCTOR CONNECTION TERMINAL WITH CLAMPING SPRING PROVIDED THEREIN

(71) Applicant: WAGO VERWALTUNGSGESELLSCHAFT MBH, Minden (DE)

(72) Inventor: Frank Hartmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/035,346

(22) Filed: Sep. 28, 2020

(65) Prior Publication Data

US 2021/0083409 A1 Mar. 18, 2021

Related U.S. Application Data

(63) Continuation of application No. PCT/EP2019/057859, filed on Mar. 28, 2019.

(30) Foreign Application Priority Data

Mar. 28, 2018 (DE) ..... 20 2018 101 727.6

(51) Int. Cl.
*H01R 9/24* (2006.01)

(52) U.S. Cl.
CPC ..... *H01R 9/2416* (2013.01)

(58) Field of Classification Search
CPC ..... H01R 9/2416; H01R 4/48; H01R 4/4836; H01R 4/4845
See application file for complete search history.

(56) References Cited

U.S. PATENT DOCUMENTS 8,632,355 B2 1/2014 Hartmann
8,858,269 B2 10/2014 Brand et al.
(Continued)

FOREIGN PATENT DOCUMENTS

DE 102009057527 A1 6/2011
DE 102011011080 A1 8/2012
(Continued)

OTHER PUBLICATIONS

International Search Report dated Jun. 18, 2019 in corresponding application PCT/EP2019/057859.

*Primary Examiner* — Vanessa Girardi
(74) *Attorney, Agent, or Firm* — Muncy, Geissler, Olds & Lowe, P.C.

(57) ABSTRACT

A conductor connection terminal, having an insulating material housing, a busbar, a clamping spring and an operating lever which is pivotably received in the insulating material housing over a pivoting range and can be pivoted between an open position and a closed position, wherein the clamping spring has an operating arm which is deflected via a spring driver of the operating lever at least in the open position, characterized in that the operating lever is supported in the open position at a first and a second support point spaced from the first, and that the operating lever is pulled against the first and the second support point by a tensile force of the clamping spring acting on the spring driver from the operating arm.

24 Claims, 16 Drawing Sheets

(56) References Cited

U.S. PATENT DOCUMENTS

| | | | |
|---|---|---|---|
| 10,164,349 | B2 | 12/2018 | Koellmann |
| 10,193,245 | B2 | 1/2019 | Lorenschat et al. |
| 10,665,965 | B2 | 5/2020 | Lorenschat et al. |

FOREIGN PATENT DOCUMENTS

| | | | | |
|---|---|---|---|---|
| DE | 102012110895 | A1 | 5/2014 | |
| DE | 102014114026 | A1 | 3/2016 | |
| DE | 102015118032 | A1 | 4/2017 | |
| DE | 202016100798 | U1 | 5/2017 | |
| DE | 202016103363 | U1 | 9/2017 | |
| DE | 102016118331 | A1 | 3/2018 | |
| EP | 2491619 | A1 * | 8/2012 | ..... H01R 4/4827 |
| WO | WO2017/081001 | A1 | 5/2017 | |

* cited by examiner

CONDUCTOR CONNECTION TERMINAL WITH CLAMPING SPRING PROVIDED THEREIN

This nonprovisional application is a continuation of International Application No. PCT/EP2019/057859, which was filed on Mar. 28, 2019, and which claims priority to German Patent Application No. 20 2018 101 727.6, which was filed in Germany on Mar. 28, 2018, and which are both herein incorporated by reference.

BACKGROUND OF THE INVENTION

Field of the Invention

The present invention relates to a conductor connection terminal with an insulating material housing, a clamping spring and an operating element which is received in the insulating material housing such that it can pivot over a pivoting range, wherein the operating lever cooperates with the clamping spring. The clamping spring can have a clamping leg and/or a contact leg. The clamping leg can have a clamping tongue. The clamping spring can have a spring arch adjoining the contact leg. The clamping leg can connect to the spring arch. The clamping spring can have an operating arm projecting from the clamping leg. The operating element can cooperate with the operating arm to move the clamping tongue. The operating element can, for example, be an operating lever which is received in the insulating material housing such that it can pivot over a pivoting range. The conductor connection terminal can also have a busbar.

The invention also relates to a conductor connection terminal with an insulating material housing, a clamping spring and an operating lever, which is received in the insulating material housing such that it can pivot over a pivoting range and can be pivoted between an open position and a closed position, wherein the clamping spring has an operating arm that is deflected at least in the open position over a spring driver of the operating lever. The conductor connection terminal can also have a busbar. The two mentioned embodiments of the conductor connection terminal can also be advantageously combined with one another.

The invention also relates to a clamping spring of a conductor connection terminal for connecting an electrical conductor to a busbar, wherein the clamping spring has a contact leg, a spring arch adjoining the contact leg and a clamping leg which adjoins the spring arch and ends with a clamping tongue, wherein an operating arm projects from the clamping leg, wherein the operating arm has a driver opening for engagement of a spring driver of an operating lever of the conductor connection terminal. The operating arm can have two side webs which are spaced apart from one another. The operating arm can have a transverse web. The transverse web can connect the side webs to one another at their free end. The side webs and the transverse web can enclose the driver opening. Such a clamping spring is suitable, for example, as a clamping spring of a conductor connection terminal of the type explained above.

The invention also relates to a conductor connection terminal with an insulating material housing, a busbar, a clamping spring and an operating lever which is received in the insulating material housing such that it can pivot over a pivoting range and can be pivoted between an open position and a closed position, wherein the clamping spring has an operating arm, which is deflected via a spring driver of the operating lever at least in the open position, wherein the operating lever is supported at least over a portion of the pivoting range with a support force on the busbar and the operating lever in the open position can be latched via at least one fixing element arranged on the operating lever in conjunction with a counter-fixing element formed on the busbar. The above-mentioned fixing element can, for example, be the fourth fixing element explained below. A part of the busbar can serve as the counter-fixing element, in particular the bent area of the busbar that is explained below.

The invention also relates to a terminal block with an insulating material housing for snapping onto a support rail with at least one first conductor connection with a first clamping point for connecting a first electrical conductor and at least one second conductor connection with a second clamping point for connecting a second electrical conductor, wherein the first conductor connection has a spring-loaded terminal connection with a clamping spring for connecting the first electrical conductor to the first clamping point by means of spring-loaded clamping, wherein the second conductor connection has an operating opening for inserting a separate operating tool for opening the second clamping point, or has an operating element designed as a pusher for opening the second clamping point, or the second conductor connection has an insulation displacement connection or a screw connection for connecting the second electrical conductor to the second clamping point.

SUMMARY OF THE INVENTION

It is therefore an object of the present invention to improve conductor connection terminals, their clamping springs and the terminal blocks formed therewith.

According to an advantageous embodiment of the invention, it is provided that the operating lever is supported on the busbar at least over a partial area of the pivoting range. Accordingly, the operating lever is supported on the busbar, which enables robust support of the operating lever and the possibility of fixing it in certain positions, for example the open position or the closed position. The busbar can be fixed in the insulating housing, i.e. other than tolerances, arranged essentially immovably in all three spatial directions in the insulating housing.

According to an advantageous embodiment of the invention, it is provided that the operating lever has at least one support projection for supporting the operating lever on the busbar. In this way, a defined support surface of the operating lever is provided via which the operating lever can be supported on the busbar. The support projection can, for example, project laterally from a pivoting plane of the operating lever, for example on one side or on both sides of the operating lever.

According to an advantageous embodiment of the invention, it is provided that the operating lever has a first guide section, the busbar has a recess, and the operating lever dips into the recess in the busbar with the first guide section at least over a partial area of the pivoting range.

In this way, the operating lever is additionally guided by the busbar during a pivoting process and is held in a desired pivoting plane with respect to laterally occurring forces. The recess in the busbar can, for example, be slot-shaped, i.e. in the form of a longitudinal slot in the busbar.

According to an advantageous embodiment of the invention, it is provided that the recess in the busbar is in the form of a slot and in particular surrounded on the circumferential side by the material of the busbar. In this way, the recess can form a robust guide for the first guide section of the operating lever. In addition, the busbar is not excessively weakened by the recess.

A conductor connection terminal with a clamping spring and a busbar which has a slot-shaped recess is also to be regarded as an independent invention. Such a conductor connection terminal can also advantageously be combined with the other mentioned embodiments of the conductor connection terminal. The slot-shaped recess can be used for different purposes, for example for fixing the busbar in the insulating material housing. Another possible application for mounting and guiding the operating lever, as explained above.

According to an advantageous embodiment of the invention, it is therefore provided that the operating lever is guided in a pivoting movement at least over a partial area of the pivoting range through the first guide section in the recess in the busbar.

According to an advantageous embodiment of the invention, it is provided that the support projection is arranged adjacent to the first guide section on the operating lever. The support projection and the first guide section can be spaced apart, for example, by a groove. In an advantageous embodiment, at least no element with a guide function is present between the support projection and the first guide section. The support projection and the first guide section can have guide surfaces which are at an angle, for example 90°, to one another. The support projection can also be arranged adjacent to the first guide section, for example laterally offset from the first guide section. In this way, the lateral guidance of the operating lever via the first guide section can be combined in a mechanically favorable manner with the support of the operating lever on the busbar by means of the support projection.

According to an advantageous embodiment of the invention, it is provided that the contact leg is supported on the busbar. This has the advantage that the clamping spring can also be supported directly on the busbar, which opens up the possibility of providing a self-supporting contact insert in which there is little force transmission to the insulating material housing.

According to an advantageous embodiment of the invention, it is provided that the operating lever is floatingly mounted in the insulating material housing. Accordingly, the operating lever does not have a fixed (rigid) axis of rotation but can also move in at least one other degree of freedom, for example a degree of displacement, in the course of the pivoting movement. In this way, the function of the operating lever can be further improved, for example with regard to fixing the operating lever in the open position and the closed position. The axis of rotation which is effective in the respective operating state of the operating lever is also referred to as the instant center of rotation. The instant center of rotation can thus be displaceable in the course of the pivoting movement of the operating lever.

According to an advantageous embodiment of the invention, it is provided that the busbar has a first busbar section on which a first clamping point of a first conductor connection of the conductor connection terminal is formed, and has a second busbar section, wherein the first busbar section is connected to the second busbar section via a bent area of the busbar in which the busbar is bent. In this way, a particularly compact conductor connection terminal with a lever operation can be realized. In addition, the bent area and/or the second busbar section can be used for further functionalities of the conductor connection terminal, for example for supporting the operating lever, for its additional guidance when pivoting and/or for fixing it, for example, in the open position.

According to an advantageous embodiment of the invention, it is therefore provided that the operating lever is supported on the busbar at least over a partial area of the pivoting area in the second busbar section. The contact leg can be mounted in or on the first busbar section on the busbar.

According to an advantageous embodiment of the invention, it is provided that in the area supported on the busbar, the operating lever has a contour adapted to the curvature of the bent area, which in the open position of the operating lever rests on the upper side of the bent area and forms a fourth fixing element for fixing the operating lever on the busbar. In this way, in the open position, i.e. in the open pivoted state of the operating lever, the operating lever can be fixed in the adapted contour by positive engagement of the bent area. The adapted contour thus forms the fourth fixing element, for example a latching element, for fixing the operating lever in the open position.

According to an advantageous embodiment of the invention, it is provided that the bent area forms an interior angle between the first busbar section and the second busbar section in the range from 105 to 165 degrees or 120 degrees to 150 degrees. This also promotes the compact design of the conductor connection terminal. In addition, an inexpensive conductor insertion direction can be achieved, for example for applications in terminal blocks.

According to an advantageous embodiment of the invention, it is provided that the bent area is designed in such a way that the busbar, starting from the second busbar section, is first bent concavely with a first radius (R1) and then transitions into a convex bent section with a second radius (R2). In other words, the radii of curvature of the first radius R1 and the second radius R2 are oriented in opposite directions. In this way, a type of "hump" can be implemented in the bent area, which is particularly suitable for positively latching the operating lever in the open position.

The bent area can in particular be designed in such a way that the busbar merges directly from the first radius into the second radius, without a non-bent area being arranged in between. As a result of the outlined arrangement with the first radius and the second radius being bent in the opposite direction, a type of hump is formed in the busbar, hence a section that is raised in relation to the adjacent areas of the busbar.

According to an advantageous embodiment of the invention, it is provided that the recess of the busbar is only arranged in the second busbar section or extends from the second busbar section into the bent area or extends from the second busbar section over the bent area into the first busbar section. In this way, that area of the busbar that serves to guide the operating lever can be spatially separated from an area of the busbar that forms a spring-loaded terminal connection with the clamping spring.

According to an advantageous embodiment of the invention, the operating arm has a driving area and the operating lever has a spring driver which cooperates with the driving area for moving the clamping tongue. In this way, the clamping tongue can be deflected by the operating lever. The driving area on the operating arm can, for example, as will be explained below, be designed as a driving opening or as a lateral cutout in the operating arm.

According to an advantageous embodiment of the invention, the spring driver is arranged at least partially or completely within the recess of the busbar in the closed position. In this way, the spring driver is moved far back so that it cannot exert any influence on the operating arm. In addition, the spring driver also acts as a guide element that guides the operating lever in the area of the closed position within the recess of the busbar.

According to an advantageous embodiment of the invention, the operating lever is supported on the busbar in that at least one support projection of the operating lever is supported on a support area of the busbar facing the operating lever. The support area is arranged, for example, on an upper side of the busbar. The first guide section or an element of the operating lever connected to it, for example the second fixing element, can project through the recess in the busbar and fulfill a further function. In this way, the operating lever, in combination with the recess, can act functionally on both sides of the busbar, that is to say both on the upper side and on the underside facing away from the upper side. The operating lever or its element projecting through the recess can thus interact with a further element of the conductor connection terminal, for example with a section of the insulating material housing, as will be explained below with regard to the second fixing element.

According to an advantageous embodiment of the invention, it is provided that the spring driver is arranged at least in the closed position in the bent area of the busbar. This, too, is conducive to providing a compact conductor connection terminal. That area of the clamping spring which is to be actuated by the spring driver can therefore be formed with only a slight projection beyond the busbar. The spring driver is preferably formed on the first guide section of the operating lever. As a result of the fact that the first guide section with the spring driver dips into the slot-shaped recess of the busbar, a low overall height of the conductor connection terminal can be achieved. In addition, the length of the operating arm can also be reduced in this way.

According to an advantageous embodiment of the invention, it is provided that the busbar has a conductor lead-through opening into which the contact leg and the clamping tongue dip. As a result, the conductor connection terminal can be designed to be particularly compact, in particular with regard to the electrical contact insert.

According to an advantageous embodiment of the invention, it is provided that the conductor lead-through opening has wall sections which project from the busbar plane on all sides and which form a material passage. This enables good contact of an electrical conductor and secure mechanical fastening of the electrical conductor. The material passage can be produced in a manner that is advantageous in terms of production technology, for example in one piece from the material of the busbar.

According to an advantageous embodiment of the invention, it is provided that the conductor connection terminal has a second conductor connection for connecting a second electrical conductor, wherein the second conductor connection is electrically conductively connected to the first conductor connection via the second busbar section or is connectable via a connecting element. In this way, several electrical conductors can be connected at the same time. The conductor connection terminal can, for example, be designed as a terminal block.

According to an advantageous embodiment of the invention, it is provided that the first busbar section extends towards its free end in a direction pointing away from the operating lever. In this way, the conductor insertion direction for inserting the first electrical conductor can be arranged favorably.

According to an advantageous embodiment of the invention, it is provided that, in the closed position, the outer surface of the manual operating section in the longitudinal direction of the operating lever runs essentially parallel to a second busbar section, which connects the first busbar section to the third busbar section or runs essentially parallel to the third busbar section. The outer surface of the manual operating section is the surface that faces away from the insulating material housing in the closed position when the operating lever is in the closed position. This allows for the overall height of the terminal block to be minimized.

According to an advantageous embodiment of the invention, it is provided that in the closed position, especially if no electrical conductor is clamped to the first clamping point, the operating arm initially runs along the first busbar section starting from the clamping leg and projects beyond the bent area. In this way, the operating arm can be arranged in a space-saving manner and still be easily gripped by the spring driver when the operating lever is moved into the open position.

According to an advantageous embodiment of the invention, it is provided that the operating arm projects from the clamping leg, wherein the operating arm has two spaced-apart side webs and a transverse web connecting the side webs at their free end, wherein the side webs and the transverse web enclose a driver opening for engaging a spring driver of the operating lever of the conductor connection terminal. This allows for favorable force transmission from the operating lever to the clamping leg with a space-saving construction of the conductor connection terminal at the same time.

According to an advantageous embodiment of the invention, it is provided that the transverse web, in combination with at least one area of the insulating material housing, forms a safeguard against pulling the operating lever out of the insulating material housing, at least when the operating lever is in the open position. Accordingly, no additional securing means, in particular no additional components, are required for securing the operating lever against being pulled out in the open position.

According to an advantageous embodiment of the invention, it is provided that the area of the insulating material housing, which forms a safeguard against pulling the operating lever out of the insulating material housing, forms a stop for the transverse web of the operating arm.

According to an advantageous embodiment of the invention, it is provided that the operating lever can be pivoted from a closed position in which a clamping edge, in particular a clamping edge of the clamping tongue, forms a clamping point with the busbar for clamping an electrical conductor, into an open position in which the clamping edge is lifted from the busbar to open the clamping point. Accordingly, the closed position of the operating lever corresponds with a closed position of the clamping point, and the open position of the operating lever corresponds with an open clamping point.

According to an advantageous embodiment of the invention, it is provided that the insulating material housing has an opening which is covered by the operating lever in the closed position of the operating lever, wherein the opening leads to the clamping spring or other electrically conductive components of the conductor connection terminal. The opening can in particular be designed as a lever lead-through slot in a canopy of the insulating material housing. In the closed position, the opening is covered, for example, by a manual operating section of the operating lever. As a result, the current-carrying elements within the conductor connection terminal are shielded from the outside environment, so that the conductor connection terminal is protected against contact (finger safety). The canopy can be designed like a housing wall of the insulating material housing which is offset somewhat inwardly with respect to the outer contour of the insulating material housing.

In addition to the aforementioned opening, the insulating material housing can have a lever opening which allows for the insertion of the operating lever in a fully assembled insulating material housing. The aforementioned opening can form part of the lever opening. In this way, in the case of the conductor connection terminal according to the invention, the operating lever can be mounted through the lever opening from above, so to speak, when the insulating material housing is fully assembled, i.e. without further lateral openings, for example.

The lever opening can be completely surrounded on the circumference by the material of the insulating material housing, i.e. by corresponding walls or other sections of the insulating material housing. If the operating lever is mounted in its final position in the conductor connection terminal, at least the manual operating section projects at least partially from the insulating material housing, i.e. the operating lever then extends through the lever opening.

The lever opening can have a simple shape, such as a rectangular shape in a plan view. The lever opening can also have more complex shapes. In particular, the lever opening can have a taper, so that the width of the lever opening changes over its longitudinal extent. For example, the tapering can be realized by the mentioned canopy, so that the lever lead-through slot is formed as a narrower area of the lever opening between the canopy elements. The width of the lever opening is measured in the transverse direction of the conductor connection terminal, wherein the direction perpendicular to the pivoting plane of the operating lever is the transverse direction of the conductor connection terminal. Here, the second guide section of the operating lever can dip into the region of the lever opening formed with the taper when the operating lever is in the closed position. For this purpose, the operating lever can have lateral recesses, by means of which the area of the operating lever, which can dip into the area of the lever opening formed with the taper, is narrower than adjacent areas, for example narrower than the manual operating section. In the closed position, the canopy can be at least partially received in these lateral recesses.

A canopy plane is defined by the surface of the canopy facing the outside of the insulating material housing. In the open position, the spring driver of the operating lever can project outward from the canopy plane.

The canopy can also serve as a stop and/or support element for the operating lever when it is in the closed position. For example, the manual operating section can rest with its underside on the canopy.

The operating element or the operating lever can in particular be designed as an integral part of the conductor connection terminal, in contrast to an operating tool that is not part of the conductor connection terminal and must be procured separately if a clamping point of the conductor connection terminal is to be opened. Because the operating element or the operating lever is designed as an integral part of the conductor connection terminal, the procurement of a separate tool is not necessary. The operating element or the operating lever is then permanently available for operating the clamping spring.

According to an advantageous embodiment of the invention, it is provided that the spring driver dips into the opening in the open position of the operating lever. In this way, the opening of the insulating material housing can also be filled in the open position, so that the conductor connection terminal is protected against contact in the open position. No additional device is required for this, rather the operating lever with its spring driver can also fulfill this function.

According to an advantageous embodiment of the invention, it is provided that the operating lever has a second guide section projecting towards the lever lead-through slot, through which the operating lever is guided in the area of the closed position. In this way, additional guidance of the operating lever in the area of the closed position can be implemented, in particular in addition to a lower guide by which the operating lever is guided through its first guide section in the recess of the busbar.

According to an advantageous embodiment of the invention, it is provided that the operating lever has at least one laterally projecting third fixing element on the second guide section by means of which the operating lever can be fixed in the closed position in the area of the canopy. This allows for simple and reliable fixing of the operating lever in the closed position.

According to an advantageous embodiment of the invention, it is provided that the operating lever has at least one second fixing element by means of which the operating lever is fixed in the open position. In this way, too, the operating lever can be securely fixed in the open position. This fixing can be present as an alternative or in addition to the previously mentioned fixing by means of the fourth fixing element on the bent area of the busbar.

According to an advantageous embodiment of the invention, it is provided that in the closed position, the second fixing element dips into a receiving pocket formed in the insulating material housing. In this way, the operating lever can be secured against being pulled out in the closed position. In this way, a type of reset brake can also be created for the operating lever, so that any lever kickback that occurs is dampened. In particular, this also prevents the operating lever from coming out or being thrown out of the insulating material housing in the event of a lever kickback.

According to an advantageous embodiment of the invention, it is provided that the operating lever is predominantly located within the area surrounded by the outer contour of the insulating material housing in each operating position. This has the advantage that the operating lever is protected by the insulating material housing and only little additional external space is required for every operating state of the operating lever, even when it is pivoted. In the open position, the operating lever can be located in a substantial area of its longitudinal extent, at least to at least 30% or at least 40%, within the area surrounded by the outer contour of the insulating material housing.

The aforementioned operating lever can also be designed as something other than a lever, for example as an operating slide or other operating element. Accordingly, the invention also relates to a conductor connection terminal of the aforementioned type, in which instead of the operating lever there is an operating element of some kind for operating the clamping leg.

According to an advantageous embodiment of the invention, it is provided that in a conductor connection terminal with an operating element of any design, which cooperates with an operating arm projecting from the clamping leg to move the clamping tongue, the operating arm has two spaced-apart side webs and a transverse web connecting the side webs at their free end, wherein the side webs and the transverse web enclose a driver opening for engagement of a spring driver of the operating element of the conductor connection terminal. This allows for good transmission of force from the operating element to the operating arm, even with a very compact design of the conductor connection terminal.

According to an advantageous embodiment of the invention, it is provided that the spring driver has a width that changes over its extension, in particular that the spring driver becomes narrower towards its free end. The width of the spring driver is measured in the transverse direction of the conductor connection terminal. This simplifies the introduction of the spring driver into the driver opening. Accordingly, the spring driver can be designed as follows: a first and/or second and/or third spring driver area is formed on the spring driver. Here, the first spring driver area can be narrower than the second spring driver area. The second spring driver area may be narrower than the third spring driver area.

The spring driver can additionally or alternatively become narrower towards its free end in a further dimension than its width, for example in the direction of its height. The height of the spring driver is measured in a direction perpendicular to the pivoting plane of the operating lever and perpendicular to the direction of the greatest longitudinal extent of the operating lever, i.e. the overall length of the operating lever.

The design of the spring driver, in that it becomes narrower in terms of its width towards its free end, can be designed such that either a continuous reduction in the width and/or a step-like reduction in the width takes place. Accordingly, at least one step and/or edge can be present as to the width dimension, wherein the step does not necessarily have to run at right angles but can run at any other angle. The design of the spring driver in that its height becomes narrower towards its free end can be designed in such a way that either a continuous decrease in height and/or a step-like decrease in height takes place. Accordingly, at least one step and/or edge can be present as to the height dimension, wherein the step does not necessarily have to run at right angles but can run at any other angle.

According to an advantageous embodiment of the invention, the spring driver is designed to be rounded at its free end in the side view of the operating lever, for example with a radius. Accordingly, there are no pointed areas and/or edges at the free end of the spring driver, but instead the aforementioned rounding.

If the operating lever is pivoted in its pivoting range, the spring driver also undertakes this pivoting movement with the operating lever.

Generally speaking, the spring driver can be made relatively long and slender in the present invention as compared to solutions in the prior art. The length of the spring driver can be, for example, at least 20% or at least 25% or at least 30% of the length of the operating lever in the support area. The area of the operating lever that extends in the longitudinal direction of the operating lever from the spring driver to the rear end, which faces away from the spring driver, is regarded as the support area. The proportion of the length of the spring driver can be, for example, at least 7% or at least 8% or at least 9% in relation to the total length of the operating lever.

According to an advantageous embodiment of the invention, it is provided that the third spring driver area forms a guide for the side webs of the operating arm when the operating element is moved into the open position. Accordingly, the side webs can each essentially rest on the third spring driver area. This avoids tilting between the operating arm and the spring driver.

According to an advantageous embodiment of the invention, it is provided that the operating lever is supported in the open position on a first and a second support point spaced therefrom and the operating lever is pulled against the first and second support point by a tensile force of the clamping spring acting on the spring driver from the operating arm. This has the advantage that the operating lever is also held and fixed in the open position by the tensile force of the clamping spring, which has the advantage over rigid fixation such as by a latching element, that even in slight deflections from this actual open position, the operating lever is withdrawn again towards the open position. In this way, the operating lever is securely fixed even when external loads occur, for example strong vibration loads.

The first and the second support point can be arranged on one and the same element of the conductor connection terminal or on different components of the conductor connection terminal. One support point can be formed, for example, on the insulating material housing, the other support point on the busbar.

According to an advantageous embodiment of the invention, it is provided that the line of action of the tensile force of the operating arm extends between the first and the second support point. In this way, robust fixation of the operating lever in the open position is easy to implement. It is particularly advantageous if the line of action of the tensile force of the operating arm runs in a central area between the first and second support points, in particular in a range of 30% to 70% of the distance between the first and second support points.

According to an advantageous embodiment of the invention, it is provided that the operating arm extends through the first and the second support points in the open position. As a result, the conductor connection terminal and in particular the electrical contact insert can be designed to be particularly compact.

According to an advantageous embodiment of the invention, it is provided that the operating lever has a second fixing element by which the operating lever is supported in the open position on the first support point, wherein the second fixing element forms a recess in the outer circumference of the operating lever. Such a recess is understood to be a concave shape of a surface. A bulge is understood to be a convex shape of a surface. Reliable latching in the sense of a latching of the operating lever is possible by means of such recesses and bulges.

According to an advantageous embodiment of the invention, it is provided that a support surface is formed on the insulating material housing, which in the open position forms the first support point, wherein the support surface is part of a bulge of the insulating material housing.

According to an advantageous embodiment of the invention, it is provided that the second support point is arranged on the busbar, in particular in the form of a bulge of the busbar facing the operating lever.

According to an advantageous embodiment of the invention, it is provided that the point of application of the tensile force into the operating lever in the open position is arranged in such a way that a torque acts on the operating lever, which is counteracted by the operating lever being supported on the first and second support points. The operating lever is thus permanently loaded with a torque when it is in the open position but is held by the support at the first and the second support points. Accordingly, the operating lever does not have to be manually held in the open position.

According to an advantageous embodiment of the invention, it is provided that a straight connecting line running through the first and second support points intersects with the operating arm, wherein an angle from the operating arm to the straight connecting line is less than 90 degrees. A straight line parallel to the straight connecting line can also intersect with the operating arm. In this case, an angle from the operating arm to the straight line parallel to the straight connecting line is less than 90 degrees.

According to an advantageous development of the invention, it is provided that the angle from the operating arm to the straight connecting line or the straight line parallel thereto is greater than 20°, in particular greater than 30° or greater than 45°. This ensures that the operating lever is supported particularly securely in the open position. The operating lever remains securely in the open position even if there is a vibration load.

According to an advantageous development of the invention, it is provided that between the plane of a housing surface of the insulating material housing on which the operating lever projects from the insulating material housing in the open position and a spatial plane running perpendicular to the pivoting plane of the operating lever and running centrally through the manual operating section of the operating lever, an angle in the range of 60° to 120° is formed. This allows for the operating lever to be gripped favorably in the open position as well as an ergonomically favorable transfer from the closed position to the open position. In an advantageous embodiment, the angular range can begin at 70°, 75° or 80° with respect to the lower value, instead of at 60°. With regard to its upper value, the angular range can end at 110°, 105° or 100° instead of at 120°.

According to an advantageous embodiment of the invention, it is provided that at least the second support point is formed by two support surfaces spaced from one another perpendicular to the pivoting plane of the operating lever, on which the operating lever is supported. This enables a multi-point support of the operating lever at spatially distributed points, in particular the three-point support explained below.

According to an advantageous embodiment of the invention, it is provided that the operating lever is supported by the two support surfaces of the second support point and by the first support point in the manner of a three-point support. As a result, the operating lever is reliably held in a mechanically defined manner.

Seen in a side view of the operating lever, three support points can be formed on the circumference of the operating lever. A central support point (second support point) of these three support points can be supported on the busbar. The other two support points (first and third support point), which surround the central support point, can be supported on the housing of the conductor connection terminal. The central support point can be designed as a single support point or as two laterally offset support points. If there are two central support points, they can be arranged eccentrically in the transverse direction of the operating lever and accordingly on both sides of a central plane of the operating lever. For example, the central support points can be created by the arrangement of the two eccentric fourth fixing elements described below.

For the mentioned three-point support in the open position, the operating lever can accordingly have at least three support points. The first fixing element or the second fixing element can form such a support point. In addition, two support points can be formed by the fourth fixing element. A further (fourth) support point can also be formed if both the first fixing element and the second fixing element form such a support point.

According to an advantageous embodiment of the invention, it is provided that the support surfaces of the second support point are arranged in respective spatial planes arranged parallel to the pivoting plane of the operating lever and the first support point is arranged in a third spatial plane arranged parallel to the first and second spatial planes, which is arranged between the first and the second spatial planes. This allows for the operating lever to be securely supported in the open position. In particular, the operating lever cannot be inadvertently released, not even when the conductor connection terminal is subjected to vibration.

According to an advantageous embodiment of the invention, it is provided that the operating lever is supported in the open position at least on a first support point, wherein the insulating material housing has a partition, on one side of which the first support point is formed and on the opposite side of which the clamping spring runs along. In this way, the clamping spring can advantageously be integrated in the insulating material housing in the area of the partition. The partition can be designed like an island made of insulating material inside the insulating material housing. In this way, the insulating material housing is involved in the support of the operating lever and other functionalities of the conductor connection terminal. This is also beneficial for a compact construction of the conductor connection terminal.

According to an advantageous embodiment of the invention, it is provided that the partition is supported and counter-supported on the clamping spring with respect to the supporting force applied by the operating lever at the first support point on the partition. Accordingly, the partition is, so to speak, clamped between two forces applied by the clamping spring, namely the support force transmitted by the operating lever and a counterforce of the clamping spring. In this way, a self-supporting system can advantageously be achieved. In addition, a plastic component is supported in this way against a metal component, which induces or introduces the force, which is advantageous when exposed to moisture, which can lead to a reduction in the stability of the plastic material.

According to an advantageous embodiment of the invention, it is therefore provided that the partition is supported and counter-supported against the support force applied by the operating lever at the first support point on the partition wall and/or on a spring arch which connects the support leg and a clamping leg of the clamping spring with each other.

According to an advantageous embodiment of the invention, it is provided that the supporting force of the operating lever is brought about by a tensile force transmitted from the operating arm of the clamping spring to the operating lever. Through the transmission of a pure tensile force, the components involved in the force transmission on the part of the clamping spring, such as parts of the operating arm, can be designed to be very material-saving and accordingly also space-saving.

According to an advantageous embodiment of the invention, it is provided that the partition is formed by solid insulating material or has at least one reinforcement, in particular at least one rib-shaped reinforcement. The insulating material can be a plastic, for example.

The embodiments of the clamping spring described below and already mentioned above are suitable, for example, as clamping springs of a conductor connection terminal of the type explained above.

The object is also achieved by a clamping spring with a contact leg, a spring arch adjoining the contact leg and a clamping leg which adjoins the spring arch and ends with a clamping tongue, wherein an operating arm projects from the clamping leg and has two side webs that are integrally molded with the clamping spring and wherein the side webs are bent out of the clamping leg of the clamping spring with a mean bending radius, and wherein the clamping spring is punched and bent from a flat sheet metal with a predetermined thickness, wherein the ratio of the mean bending radius to the thickness of the sheet metal is less than 3. The mean bending radius relates to a material center line of the sheet metal. In this way, the introduction of the force of the operating lever into the clamping spring via the operating arm can be optimized. This results in a direct transmission, a short stroke and as a result essentially no stretching in the operating arm. In addition, a construction of this type allows for the components used for the conductor connection terminal and the entire conductor connection terminal to be manufactured easily. This embodiment of the clamping spring can advantageously be combined with all of the other variants described.

The thickness of the sheet metal of the clamping spring can be selected in particular depending on the nominal conductor diameter or nominal conductor cross-section of the conductor connection terminal, for example as follows:

| Nominal conductor cross-section | Sheet metal thickness |
|---|---|
| 2.5 $mm^2$ | 0.34 mm |
| 4 $mm^2$ | 0.43 mm |
| 6 $mm^2$ | 0.45 mm |
| 10 $mm^2$ | 0.55 mm |

According to an advantageous embodiment of the invention, it is provided that the transverse web is adjoined by a tab which projects from the plane of the driver opening and has a curvature, wherein the convex surface of the curvature points towards the driver opening. In this way, a bent support area can be provided on the operating arm which can rest in a favorable manner on the spring driver and can slide along on this during a pivoting movement of the operating lever.

According to an advantageous embodiment of the invention, it is provided that the tab is formed in one piece with the transverse web and is bent away from the transverse web. This allows for a simple production of the clamping spring with the operating arm, for example in a stamping and bending process.

According to an advantageous embodiment of the invention, it is provided that the free end of the operating arm is bent with the transverse web in the direction pointing away from the spring arch. This makes it possible to provide a strong curvature on the tab without the need for excessive degrees of deformations during the bending process.

According to an advantageous embodiment of the invention, it is provided that an edge formed at the free end of the tab points away from the driver opening. In this way, excessive wear of the spring driver of the operating lever is avoided. In particular, contact between the possibly sharp-edged end edge of the tab and the spring driver can be avoided.

According to an advantageous embodiment of the invention, it is provided that the width of the driver opening, which is defined by the inner distance between the side webs, varies over the longitudinal extension of the operating arm, in particular with a reduction in width towards the free end of the operating arm. The reduction in width can be designed in steps. In this way, components of different widths can be guided through the driver opening, for example the spring driver on the one hand and further components such as parts of the clamping spring, for example the contact leg, on the other.

According to an advantageous embodiment of the invention, it is therefore provided that the contact leg extends through the driver opening, in particular through the wider area of the driver opening. The wider area of the driver opening is that area in which the inner distance between the side webs is greater than in one or more other areas of the driver opening.

According to an advantageous embodiment of the invention, it is provided that the clamping tongue tapers starting from the root area towards the clamping edge at the free end. In this way, a possible tilting of the clamping tongue in an opening in the busbar can be avoided, for example, due to a possible inclined position of the clamping spring. That part of the clamping spring at which the clamping leg branches into the clamping tongue and the operating arm is regarded as the root area. The root of the clamping tongue and the root of the operating arm are thus located in this part of the clamping spring.

According to an advantageous embodiment of the invention, it is provided that the clamping leg has a clamping leg arch formed between the spring arch and the root area, and that the operating arm has a length from the root area to a force application area designed to act with an operating force on the operating arm, which is greater than the length of the clamping leg from the root area to the vertex of the clamping leg arch. This can be achieved for example in that with respect to operation, the effective length of the operating arm, measured from the junction of the operating arm from the clamping leg to the bent support area, is greater than the length of the clamping leg, measured from the junction of the operating arm from the clamping leg to the vertex of the spring arch. In this way, a spring with a shortened buckling length can be achieved. Such a clamping spring is better protected against undesired bending or kinking of the clamping leg when a clamped electrical conductor is pulled from the outside.

According to an advantageous embodiment of the invention, it is provided that the clamping leg has a clamping leg arch formed between the spring arch and the root area, which, when the operating lever is moved from the closed position to the open position, strikes part of the insulating material housing of the conductor connection terminal. In this way, the buckling length of the clamping leg can advantageously be shortened.

According to an advantageous embodiment of the invention, it is provided that the smallest width of a side web is a maximum of 20% of the largest width of the clamping leg. In this way, very thin side webs can be provided, which helps to save material on the clamping spring and also contributes to the compact design of the conductor connection terminal. Since the side webs only have to transmit tensile forces, implementation in a very narrow form is easily possible.

According to an advantageous embodiment of the invention, it is provided that the smallest width of a side web is at most four times the thickness of the sheet metal.

According to an advantageous embodiment of the invention, it is provided that the operating lever has a spring driver which extends through the driver opening at least in the open position. In this way, the clamping leg can be deflected by the spring driver of the operating lever.

According to an advantageous embodiment of the invention, it is provided that the spring driver extends through the narrower area of the driver opening at least in the open position. Since only tensile forces have to be transmitted through the operating arm and its side webs, these can be made correspondingly thin, which leads to savings in the material of the clamping spring. In addition, in one embodiment of the clamping spring in which at least the clamping tongue is provided by an area punched out of the operating arm in which the driver opening is formed, the clamping tongue can be provided with a relatively large clamping width, which in turn allows for clamping of relatively large conductor cross-sections.

According to an advantageous embodiment of the invention, it is provided that a bent support area is formed on the operating arm in the area of the curvature of the tab, wherein the operating lever has a socket support on which the bent support area slides along the operating arm of the clamping spring when the operating lever is pivoted. In this way, the bent support area can be guided reliably, without tilting and with little friction over the operating lever and slide thereon. The socket support can in particular be arranged on the spring driver.

The bent support area can have a constant curvature or a varying curvature. In any case, there is a curvature over the entire extension of the bent support area and no sharp edge or kink. The smallest radius of curvature of the bent support area can be greater than or equal to half the thickness of the sheet metal of the clamping spring.

According to an advantageous embodiment of the invention, it is provided that the operating arm, starting from the clamping leg, initially runs along the first busbar section and projects with at least a part of the driver opening beyond the bent area of the busbar. In this way, the spring driver can be inserted into the driver opening through the busbar without hindrance. In addition, the conductor connection terminal can be designed to be particularly compact, for example in that the operating arm extends closely along the first busbar section.

According to an advantageous embodiment of the invention, it is provided that the operating arm of the clamping spring at least partially slides off the busbar when the clamping leg is displaced. Accordingly, the operating arm is thus additionally guided when the operating lever is pivoted through the busbar.

In particular in the closed position, when no electrical conductor is clamped to the clamping point, the operating arm can run at least approximately parallel to the busbar, for example parallel to the first busbar section. As a result, the conductor connection terminal can be created in a particularly compact manner. In this way, a relatively large lever arm for operating the clamping leg is also realized. This allows for the operating force of the operating lever to be reduced. In this essentially parallel area between the operating arm and the busbar, a small distance can be created between the operating arm and the busbar, which is also beneficial for a small-sized construction of the conductor connection terminal. For example, the distance between the operating arm and the busbar in this area can be smaller than the material thickness of the busbar in this area or less than twice the material thickness of the busbar.

According to an advantageous embodiment of the invention, it is provided that the operating lever has a spring driver which does not touch the operating arm in the closed position. Wear between the spring driver and the operating arm in the closed position is thus avoided. Here, the spring driver can at least partially extend into the driver opening.

According to an advantageous embodiment of the invention, it is provided that the operating lever has a spring driver which, in the closed position, does not extend into the driver region of the clamping spring, for example not into the driver opening. This maximizes the distance between the spring driver and the operating arm.

According to an advantageous embodiment of the invention, it is provided that a guide element is formed on the insulating material housing which, at least in certain operating situations and/or pivoting positions of the operating lever, forms a housing-side guide for the operating arm. The operating arm can be guided by the guide element in particular when the operating lever executes a pivoting movement close to the open position. This counteracts excessive deflection or bending of the operating arm, in particular at the transition to the clamping leg. In addition, as a result of this configuration, the operating lever initially performs a certain idle stroke during the pivoting movement from the closed position to the open position without operating forces originating from the clamping spring. Thus, the operating lever can initially be actuated essentially without any effort, for example with the fingertip, in order to then be able to grip it manually.

According to an advantageous embodiment of the invention, it is provided that the active load arm of the operating lever is shorter in the open position than in the closed position. This allows for an ergonomic operating of the operating lever that is pleasant to the touch. In particular at the end of the pivoting movement in the direction of the open position, when the spring force of the clamping spring increases, the changed transmission ratio keeps the operating force at a comfortable level, for example at a force level that is essentially constant over the pivoting angle.

According to an advantageous embodiment of the invention, it is provided that the transverse web and/or the bent support area slides along the spring driver, in particular on the socket support, when the operating lever is moved from the closed position to the open position and thereby approximates the instantaneous center of rotation of the operating lever, for example, the instantaneous center of rotation which is effective in the course of the pivoting movement of the operating lever. In this way, the shortening of the load arm during the opening movement of the operating lever can be realized in a reliable manner. The extent by which the transverse web approaches the instantaneous center of rotation of the operating lever when the operating lever moves from the closed position to the open position can be, for example, at least 5% or at least 10% of the length of the spring driver, measured in the longitudinal direction of the operating lever.

According to an advantageous embodiment of the invention, it is provided that the conductor connection terminal has at least one force reducing mechanism, by means of which the amount of the contact force can be reduced when the operating lever is released from the snapped open position and/or when the operating lever engages in the open position. In this way, the contact point that is loaded with the support force is relieved when the operating lever is released. This has the advantage that the release of the operating lever is simplified and wear on the components in contact with one another can be reduced or avoided entirely. By means of the force reducing mechanism, the amount of the support force can be reduced to a greater or lesser extent, depending on the embodiment, up to a complete cancellation of the support force (support force equal to zero). Accordingly, those components which are loaded with the contact force at the contact point can be separated from one another by the force reducing mechanism. For example, a region of the operating lever supported on the busbar can be lifted off the busbar.

According to an advantageous embodiment of the invention, it is provided that the force reducing mechanism is at least partially formed by mechanical elements of the operating lever, the clamping spring and/or the insulating material housing. Accordingly, no additional elements are required to form the force reducing mechanism or at least essential parts thereof. Accordingly, the force reducing mechanism can be realized in a very simple manner without complicated structures.

According to an advantageous embodiment of the invention, it is provided that the mechanical elements are formed by interacting contours of the operating lever, the clamping spring and/or the insulating material housing. This also allows for the force reducing mechanism to be easily implemented. For example, the force reducing mechanism can be formed on the operating lever by the first support point in combination with the point of application of the clamping spring, for example by the contact point between the first fixing element of the operating lever and the second latching edge of the insulating material housing, in combination with the socket support of the operating lever and the bent support area, which is formed on the operating arm of the clamping spring. These two contact points, i.e. the first support point and the contact point between the operating lever and the clamping spring, can be arranged in such a way that when the operating lever is moved from the open position towards the closed position, there is initially a tilting moment that leads to relieving the load of the contact point of the operating lever on the busbar and to the aforementioned lifting at this location.

According to an advantageous embodiment of the invention, it is provided that the contact force can be reduced by the force reducing mechanism to an amount which is less than the amount of the force acting on the operating lever by the clamping spring via the operating arm. In this way, the contact point between the fixing element arranged on the operating lever and the counter-fixing element can be reduced to such an extent that the aforementioned lifting of the operating lever is made possible at this location.

According to an advantageous embodiment of the invention, it is provided that the force reducing mechanism is set up to reduce the support force by shifting the force of the clamping spring force acting on the operating lever to another contact point of the operating lever, at which the operating lever is supported in the conductor connection terminal. This has the advantage that the reduction in the contact force produced by the force reducing mechanism does not produce any disruptive effects for the user and the user in particular does not feel an excessive increase in the expenditure of force when releasing the operating lever.

According to an advantageous embodiment of the invention, it is provided that the operating lever is supported on a main contact point in the conductor connection terminal, via which the largest force of the clamping spring acting on the operating lever can be transmitted to at least one other element of the conductor connection terminal, wherein the main contact point is discontinuously displaceable over its pivoting range at least twice, at least three times or at least four times when the operating lever is pivoted. The location of the main contact point can thus be changed several times in the course of the pivoting movement of the operating lever. In particular, the change can take place discontinuously, i.e. abruptly. This is also to be regarded as an independent aspect of the present invention. The displaceability of the main contact point enables a pivoting mechanism of the operating lever to be realized, which enables a comparatively complex, discontinuous sequence of movements, which in turn enables particular advantages in terms of haptics for the user and protection of the elements. The comparatively complex sequence of movements can, however, be made possible by construction features that can be implemented relatively easily, so that the conductor connection terminal can nevertheless be provided inexpensively.

According to an advantageous embodiment of the invention, it is provided that a first location of the main contact point is formed in the fixed open position between the busbar and a region of the operating lever supported on the busbar. The first location of the main contact point can be, for example, the second support point.

According to an advantageous embodiment of the invention, it is provided that the operating lever is supported in the open position on a first and a second support point spaced therefrom, wherein the operating lever is supported on the insulating material housing at the first support point and the operating lever is supported on the busbar at the second support point, wherein a second location of the main contact point is formed at the first support point of the operating lever on the insulating material housing.

According to an advantageous embodiment of the invention, it is provided that the operating lever has at least one laterally projecting support element which is spaced apart from the busbar in the entire pivoting range, and a third location of the main contact point is formed between the lateral support element of the operating lever and the insulating material housing. The laterally projecting support element thus does not have the function of an axis of rotation in the sense of a fixed support, but only temporarily forms a support for the operating lever in certain pivoting situations of the operating lever in the sense of a support against the insulating material housing.

According to an advantageous embodiment of the invention, it is provided that the operating lever has a first guide section, which dips into a recess in the busbar at least over a partial area of the pivoting area, wherein a fourth location of the main contact point is formed between the first guide section and the insulating material housing.

According to an advantageous embodiment of the invention, it is provided that the operating lever has at least one support projection for supporting the operating lever on the busbar, which projects laterally from the operating lever opposite the first guide section, wherein a fifth location of the main contact point is formed between the support projection of the operating lever and the busbar.

According to an advantageous embodiment of the invention, it is provided that the first support point forms a first instantaneous center of the pivoting movement of the operating lever when the operating lever is released from the snapped open position. In this way, a multiple function of the first support point can advantageously be created, namely in the open position to support the operating lever and to fix it, and when releasing the operating lever as an instantaneous center of rotation and second location of the main contact point.

The previously described conductor connection terminal can, for example, be designed as a terminal block, for example as the terminal block mentioned above.

According to an advantageous embodiment of the invention, it is provided that the first conductor connection has an operating lever that can be operated without tools, wherein the operating lever is pivotably mounted in the insulating material housing for operating the spring-loaded terminal connection of the first conductor connection, and the operating lever has a manual operating section for manually operating the operating lever. This allows for convenient operation of the first conductor connection without the need for additional tools.

According to an advantageous embodiment of the invention, it is provided that the operating section of the operating lever of the terminal block projects at least partially over the outer contour of the insulating material housing throughout the entire pivoting process. In particular, the free end of a manual operating section (operating handle) of the operating lever can project beyond the outer contour of the insulating material housing. This allows for simple operation of the operating lever in the vicinity of the closed position.

According to an advantageous embodiment of the invention, it is provided that the operating lever, when it is placed in the open position, automatically maintains this position in the open position. This is guaranteed by the construction of the conductor connection terminal. For example, the automatic holding of the operating lever in the open position can be implemented by resting it on the first and second support points. In addition, the operating lever can be kept in the open position in that it is pulled against the first and the second support points with a tensile force exerted by the clamping spring on the operating lever.

Generally speaking, the operating of the conductor connection terminal by the operating lever differs from the prior art in that the operating lever transmits a tensile force to the clamping spring via its spring driver in order to deflect the clamping leg. Accordingly, no pressure force is transmitted, as is the case in operating solutions with a pusher. Another difference is the type of manual operation of the operating lever in contrast to a pusher. In the present invention, it is advantageous to apply a tensile force manually to the operating lever on the manual operating section in order to move the operating lever from the closed position to the open position. In the course of this movement, the manual operating force can also be changed to a pressure force.

In contrast to proposals from the prior art, the conductor connection terminal according to the invention can be designed such that the conductor insertion opening is designed as part of the insulating material housing and not as part of other elements, such as the operating lever. In this way, good accessibility to the conductor insertion opening and an electrical conductor introduced into the conductor insertion opening can be achieved.

According to an advantageous embodiment of the invention, it is provided that the operating lever is mounted in the insulating material housing, i.e. corresponding mounting elements are formed within the insulating material housing.

In the case of the terminal block mentioned, one or more first conductor connections and/or one or more second conductor connections can be present.

According to an advantageous embodiment of the invention, it is provided that the second conductor connection has an operating opening for inserting a separate operating tool for opening the second clamping point. This allows for simple manual operating when opening the second clamping point. While the operating lever is part of the terminal block, the separate operating tool is not part of the terminal block and is therefore "separate". The operating tool can be a screwdriver, for example.

Alternatively, the second clamping point can also have a lever operating for opening, for example in that the terminal block is designed with a further operating lever which is used to open the second clamping point.

According to an advantageous embodiment of the invention, it is provided that the second conductor connection has an operating element designed as a pusher for opening the second clamping point. The lever can be part of the terminal block.

The second conductor connection, like the first conductor connection, can also be designed as a spring-loaded terminal connection with a clamping spring for the clamping connection of the second electrical conductor.

According to an advantageous embodiment of the invention, it is provided that the second conductor connection has an insulation displacement connection or a screw connection for connecting a second electrical conductor. This allows for an alternative implementation of the second conductor connection if it is not to be designed as a spring-loaded terminal connection.

According to an advantageous embodiment of the invention, it is provided that the operating section of the operating lever of the terminal block projects at least partially beyond the outer contour of the insulating material housing throughout the entire pivoting process. This allows for simple manual operating of the operating lever. The operating lever is easy to grip and easy to operate with one finger. In addition, the operating section can be easily felt.

According to an advantageous embodiment of the invention, it is provided that the first conductor connection has a first busbar section to which the first electrical conductor can be connected by means of the clamping spring, and the second conductor connection has a third busbar section to which the second electrical conductor can be connected, wherein the first busbar section is electrically conductively connected to the third busbar section or can be connected via an electrical connection element of the terminal block. The first and third busbar sections can be part of a common busbar, that is to say permanently connected to one another, or busbar sections which are separate from one another and which are only connected to one another when required, such as for example in the case of a disconnecting terminal.

According to an advantageous embodiment of the invention, it is provided that the terminal block has a busbar that extends from the first busbar section to the third busbar section. The busbar accordingly produces an electrically conductive connection from the first busbar section to the third busbar section. For this purpose, the busbar can be formed in one piece or composed of individual parts.

The busbar can run in a straight line or at least substantially in a straight line in the second busbar section and in the third busbar section. The busbar can also have one or more gradations in the second busbar section and/or in the third busbar section, for example such that, starting from the bent area, a gradation adjoins in the second busbar section and/or in the third busbar section, by means of which the further course of the busbar is lower than the bent area starting from the regions of the second and/or third busbar sections that precede the bent area. In this way, lower-lying conductor connection points can be implemented in the second and/or third busbar section, as a result of which the conductor connection terminal can be designed to be particularly compact and small.

According to an advantageous embodiment of the invention, it is provided that the first conductor connection has a first conductor insertion opening, the second conductor connection has a second conductor insertion opening and the operating lever is arranged at least with the predominant part of its longitudinal extension between the first and the second conductor insertion opening. In this way, the operating lever is arranged relatively centrally in the terminal block and therefore requires little additional installation space.

According to an advantageous embodiment of the invention, it is provided that the first conductor connection has a first conductor insertion direction in which the first electrical conductor can be guided through the first conductor insertion opening to the first clamping point, and the second conductor connection has a second conductor insertion direction in which the second electrical conductor can be guided through the second conductor insertion opening to the second clamping point, wherein the first conductor insertion direction is arranged obliquely to the second conductor insertion direction by an angular offset. This allows for simple handling of the terminal block when connecting the first and the second electrical conductors, in particular if the terminal block is already attached to a support rail. Both conductor insertion openings are then easily accessible. The angular offset can be at least 30°, for example.

According to an advantageous embodiment of the invention, it is provided that the terminal block has at least one support rail fastening element on a support rail fastening side, by means of which the terminal block can be fastened to a support rail. This allows for a reliable and standard-compliant fastening of the terminal block, as well as a series of a plurality of terminal blocks, on the support rail.

According to an advantageous embodiment of the invention, it is provided that the first conductor insertion opening is completely or at least partially visible in a plan view of the housing side of the terminal block facing away from the support rail fastening side. In this way, the user can easily see where the first electrical conductor is to be inserted, in particular if the terminal block is already attached to the support rail.

According to an advantageous embodiment of the invention, it is provided that the first conductor insertion opening is arranged below the operating lever in a plan view of the housing side of the terminal block facing away from the support rail fastening side and is completely or at least partially visible in every pivoted position of the operating lever. The first conductor insertion opening thus remains at least partially visible, i.e. it is at least not completely covered by the operating lever. Nevertheless, it is possible to arrange the operating lever in an ergonomically favorable and space-saving manner and, in particular, to allow for a certain projection of the operating section of the operating lever beyond the outer contour of the insulating material housing.

According to an advantageous embodiment of the invention, it is provided that the operating lever is embedded in the housing side of the insulating material housing of the terminal block facing away from the support rail fastening side. This allows for space-saving accommodation with good accessibility of the operating lever.

According to an advantageous embodiment of the invention, it is provided that at least the outer surface of the manual operating section of the operating lever in the closed position follows the surface contour of the insulating material housing adjoining the outer surface of the manual operating section. Accordingly, the outer surface of the manual operating section adapts to the surface contour of the insulating material housing, such that there is essentially no shoulder or step-like transition there. Thus, the outer surface of the manual operating section can form a continuous surface with the housing top side of the insulating material housing.

According to an advantageous embodiment of the invention, it is provided that the operating lever is designed to be self-retaining in the open position. This has the advantage that the operating lever does not have to be held by the user. The operating lever can be latched, for example, by one or more of the first, second or fourth fixing elements.

In the context of the present invention, the undefined term "a" is not to be understood as a numerical word. If, for example, a component is mentioned, this is to be interpreted in the sense of "at least one component". As far as angles are given in degrees, these refer to a circle of 360 degrees (360°).

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
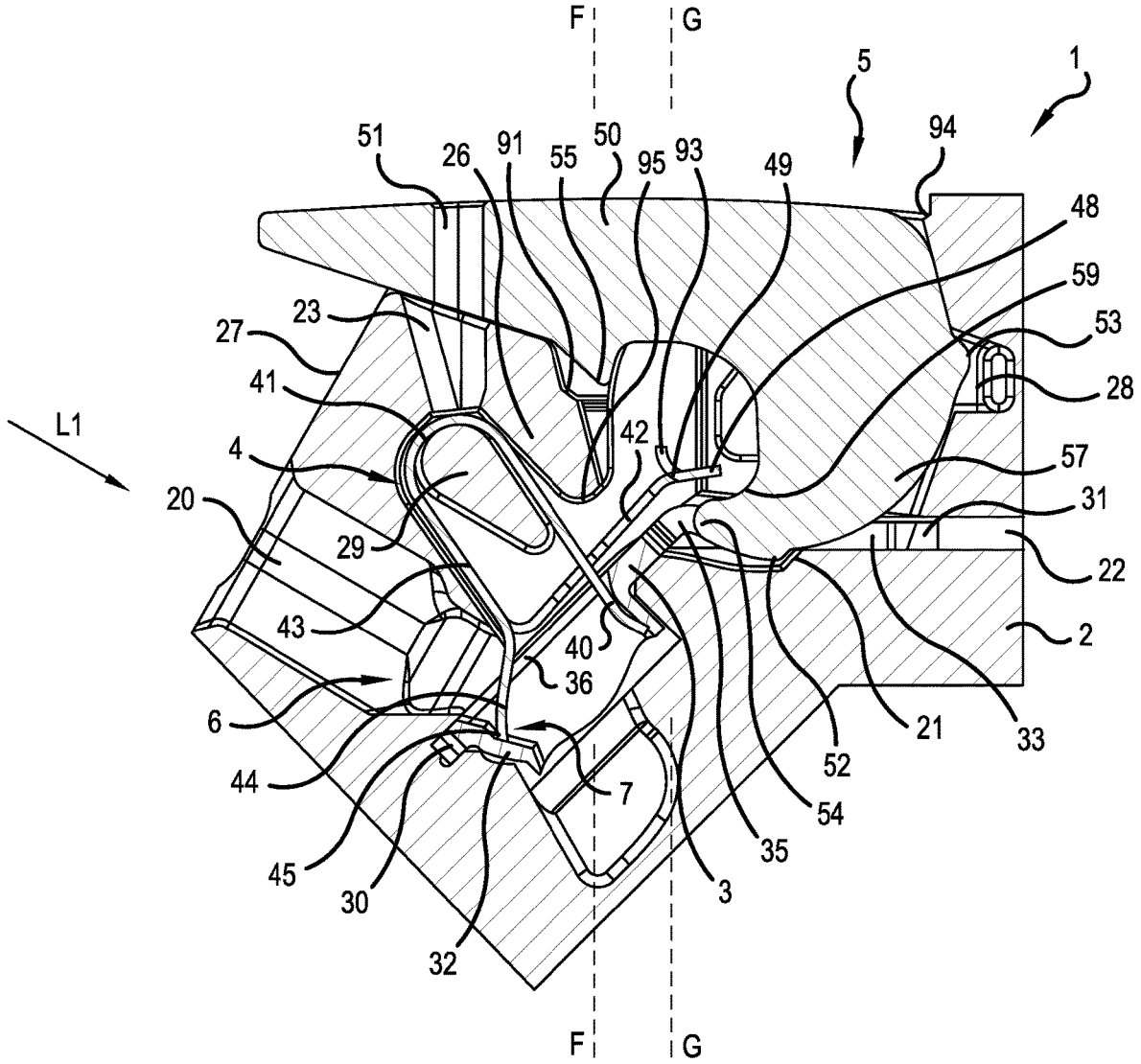
FIG. 1 shows a conductor connection terminal in a sectional side view in the closed position.

The conductor connection terminal 1 has an insulating material housing 2, a busbar 3, a clamping spring 4 and, as an operating element for operating the clamping spring 4, an operating lever 5.

The insulating material housing 2 has a conductor insertion opening 20 through which an electrical conductor can be inserted in a conductor insertion direction L1 and guided to a first clamping point 7 of a first conductor connection 6, where the electrical conductor can be clamped by spring force by means of the clamping spring 4 and the busbar 3. The insulating material housing 2 also has a busbar duct 22 through which at least a part of the busbar 3 is guided and is at least partially fixed and/or supported there.

The busbar 3 has a first busbar section 30 and a second busbar section 31. The first busbar section 30 is connected to the second busbar section via a bent area 35, so that the busbar 3 as a whole has a bent and/or angled shape. The second busbar section 31 is arranged at least predominantly within the busbar duct 22. The busbar 3 has a conductor lead-through opening 36 in the first busbar section 30, through which an electrical conductor that is to be clamped can be guided. The conductor lead-through opening 36 can be surrounded by side walls formed on the first busbar section 30, which e.g. can be designed in the form of a material passage 32. For example, the conductor lead-through opening 36 can have wall sections projecting on all sides from the busbar plane, which form the material passage 32.

The clamping spring 4 has a contact leg 40 by means of which the clamping spring 4 is supported against the spring forces introduced by the clamping leg 43. The contact leg 40 can be supported in the first busbar section 30 on the busbar 3. As shown, the support takes place, for example, in that the free end of the contact leg 40 rests against the inside of the conductor lead-through opening 36 and/or the material passage 32. The clamping spring 4 extends from the contact leg 40 further over the spring arch 41 to the clamping leg 43. The operating arm 42 projects from the clamping leg 43, wherein the operating arm 42 is bent at a relatively large angle, for example greater than 45 degrees or greater than or equal to 90 degrees, from the clamping leg 43. The operating arm 42 ends at its free end with a transverse web 48 which, at its end, delimits the driver opening 46, which cannot be seen in FIG. 1. In the free end area of the operating arm 42, a material section of the clamping spring material is bent to form a tab 93 which projects from the remaining course of the operating arm 42 and which has at least part of a bent support area 49 of the operating arm 42. The bent support area 49, together with the socket support 59 of the operating lever 5, forms a type of mounting made up of a cylinder and a cylindrical shell, similar to a ball-and-socket bearing.

In addition, the clamping leg 43 extends to a clamping tongue 44, which is bent from the clamping leg 43 in the opposite direction than the operating arm 42. The clamping tongue 44 ends at the free end of the clamping leg 43 with a clamping edge 45. The clamping edge 45, together with the busbar 3, i.e. the conductor lead-through opening 36 and/or the material passage 32, forms the first clamping point 7 of the first conductor connection 6 for an electrical conductor to be clamped there. Accordingly, the contact leg 40 and the clamping tongue 44 dip into the conductor lead-through opening 36.

Figure 4:
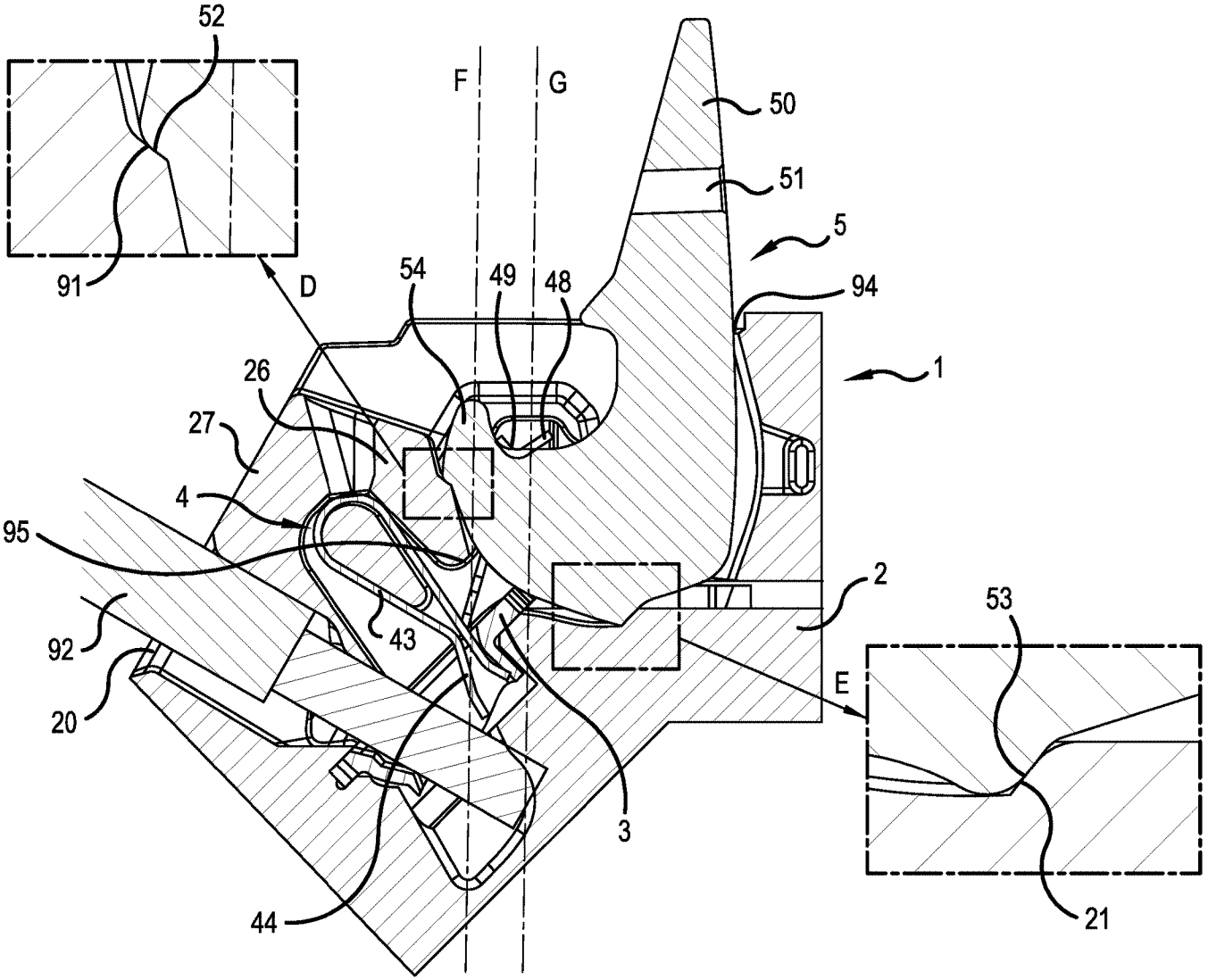
FIG. 4 shows the conductor connection terminal according to FIG. 1 in a sectional side view in the open position.

The conductor connection terminal 1 has an operating lever 5 which is predominantly arranged in the area surrounding the insulating material housing 2 and which essentially extends outward with a manual operating section 50, for example an operating handle, where the operating lever 5 can be actuated manually. The first clamping point 7 can be opened or closed by manually operating the operating lever 5. If the operating lever 5 is in the closed position shown in FIG. 1, the first clamping point 7 is also closed. If the operating lever 5 is moved to the open position (as shown in FIG. 4), the first clamping point 7 is open. In this open position, an electrical conductor can be inserted into or removed from the first clamping point 7 without any effort, since operating the operating lever 5 moves the clamping edge 45 away from its contact point on the busbar 3 or the electrical conductor.

The conductor insertion direction L1 can be oriented obliquely to the extension direction of the manual operating section 50. Accordingly, an angle can be formed between the extension of the outer surface of the manual operating section 50, which runs approximately flush with the housing surface, and the conductor insertion direction L1. The angle can be relatively small, e.g. in the range of 20 to 60 degrees.

The operating lever 5 is pivotably mounted in the insulating material housing 2. In this case, no fixed support axis is provided, rather the operating lever 5 can also perform certain displacement movements in the course of a pivoting movement from the closed position to the open position and vice versa.

The operating lever 5 has a test recess 51 penetrating the operating lever 5, e.g. in the area of the manual operating section 50. In the closed position, the test recess 51 is essentially aligned with the test opening 23 of the insulating material housing 2. The test opening 23 extends as far as the clamping spring 4, e.g. up to the spring arch 41. If a test pin is inserted through the test recess 51 and the test opening 23, the clamping spring 4 can be electrically contacted in this way and an electrical measurement can be carried out. The clamping spring 4 is fixed via an overload protection element 29, so that a counter support is created for the test pin. In addition, excessive movement and stress on the clamping spring 4 is prevented by the overload protection element 29 in the insulating material housing 2. The overload protection element 29 can be designed as an island-shaped material area of the insulating material housing 2, which is arranged within the spring arch 41.

In the open position, the clamping spring 4 can rest against the overload protection element 29, that is, it can strike against the overload protection element 29 with one or more areas, for example the spring arch 41 and/or the clamping leg 43.

In several respects, the operating lever 5 is guided, mounted and fixed in certain positions such as the closed position and the open position in the conductor connection terminal 1. For this purpose, the operating lever 5 has a first fixing element 52 in the lower area, i.e. the part of the operating lever 5 remote from the manual operating section 50, and a second fixing element 53 in the rear area, i.e. the area facing away from the spring driver 54. The first and/or the second fixing element 52, 53 can be designed as a latching element, for example. The first and/or the second fixing element 52, 53 can be designed as a material projection or cam. The fixing elements 52, 53 can be molded directly onto the material of the operating lever 5. The operating lever 5 also has a first guide section 57 via which the operating lever 5 is guided in a pivoting movement, in particular in the busbar 3, and is secured against tilting sideways. The first guide section 57 runs through a recess 33 in the busbar 3, for example a recess 33 in the first busbar section 31. The recess can be designed as a longitudinal slot, for example. If the operating lever 5 is pivoted, for example from the closed position to the open position, the first guide section 57 runs through this recess 33. It can also be provided that during a pivoting movement, the operating lever 5 runs along an inner guide contour of the insulating material housing with the second fixing element 53 and is additionally supported and/or guided by this.

As mentioned, the operating lever 5 is used to actuate the clamping spring 4. For this purpose, the operating lever 5 has a spring driver 54, which is shaped like a driver tooth and in the assembled state projects from the operating lever 5 in the direction of the clamping spring 4, in particular in the direction of the operating arm 42. Here, the spring driver 54 is initially not in engagement with the operating arm 42 in the closed position, so that in this closed position no spring load acts on the operating lever 5. The spring driver 54 can be located, for example, in the region of the bent area 35 of the busbar 3, at least in the closed position. The spring driver 54 merges at a bent inner contour of the operating lever 5 into a support area of the operating lever 5, which in this case forms a socket support 59. As will be explained below, this socket support 59 interacts with the bent support area 49 of the clamping spring 4 when the operating lever 5 is pivoted.

The operating lever 5 is fixed in the closed position shown in FIG. 1 by other means than the first and second fixing element 52, 53. In the closed position, the second fixing element 53 is arranged within a free space in the insulating material housing 2, namely in a receiving pocket 28. The second fixing element 52 is located in the vicinity of a first latching edge 21 of the insulating material housing 2, which, however, has no essential function in the closed position. In the insulating material housing 2, a second latching edge 91 is also formed, which has a function, as will be described below, in the open position of the operating lever 5. Likewise, hereinafter, the structure and operation of the second guide section 55 of the operating lever 5 are explained with reference to further figures. By receiving the second fixing element 53 in the receiving pocket 28, the operating lever 5 can be secured in the closed position against falling out of the insulating material housing 2. Furthermore, receiving the second fixing element 53 in the receiving pocket 28 ensures that the operating lever 5 is unscrewed in the event of a kickback when the operating lever 5 is transferred from the open position to the closed position. A further safeguard against falling out or removal of the operating lever 5 is achieved by the canopy 24, in particular in the open position.

A guide element 95 is also formed on the insulating material housing 2. The guide element 95 forms, at least in certain operating situations and/or pivoting positions of the operating lever 5, a housing-side guide for the operating arm 42. For example, at least temporarily during a pivoting movement of the operating lever, the operating arm 42 can slide along the guide element 95 into the open position.

The conductor connection terminal 1 seen in FIG. 1 can be designed as a single connection terminal, as shown, or as part of a conductor connection terminal comprising further conductor connections, e.g. as part of the conductor connection terminal explained below with reference to FIG. 15.

Figure 2:
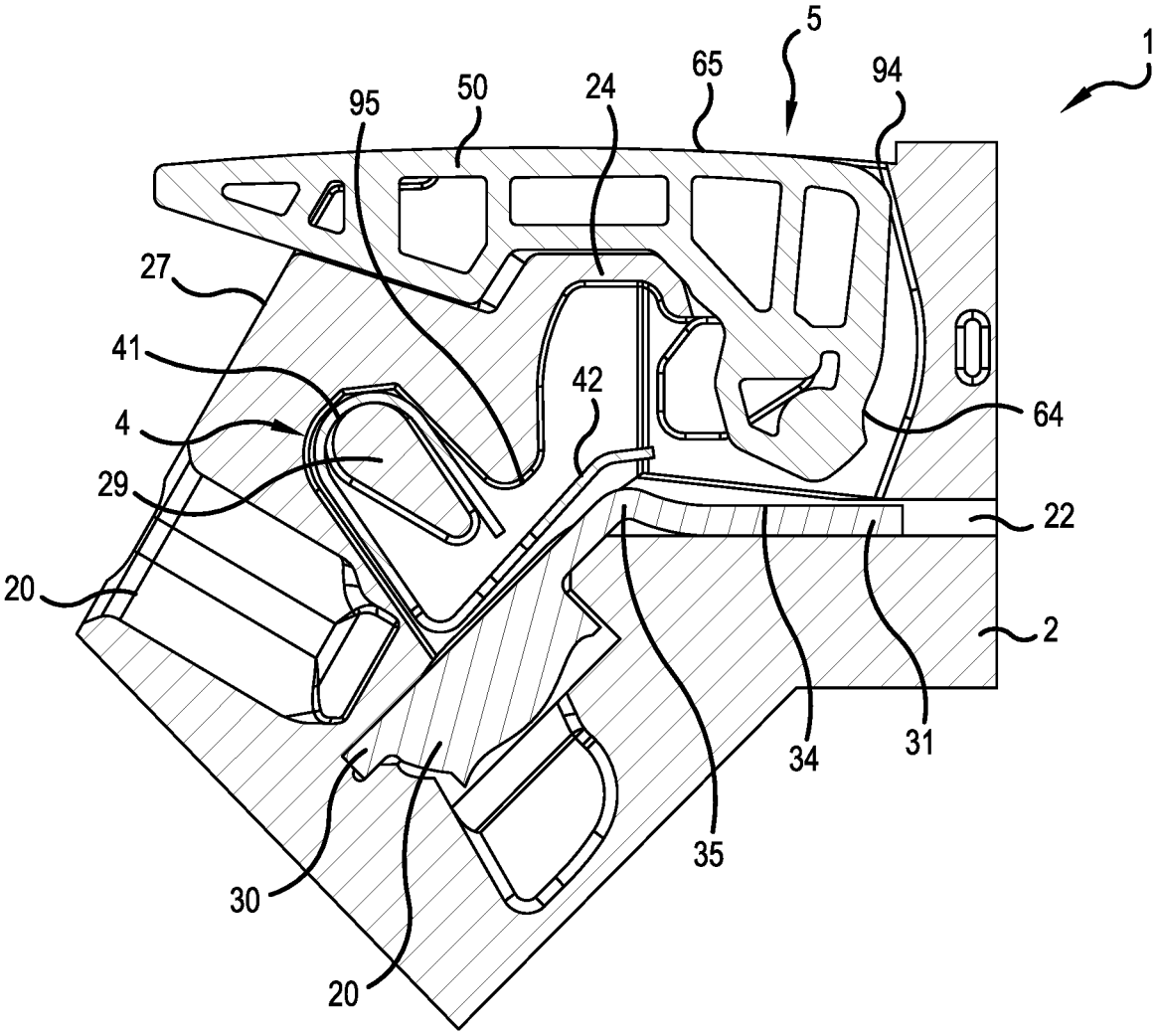
FIG. 2 shows the conductor connection terminal of FIG. 1 in a sectional side view in A further sectional plane.

As a further feature of the insulating material housing 2, FIG. 2 shows a canopy 24 arranged below the manual operating section 50, i.e. a kind of boundary wall of the insulating material housing 2, which ensures that the current-carrying elements within the conductor connection terminal 1 are shielded from the outside environment, so that contact safety (finger safety) of the conductor connection terminal 1 is created in particular in the open position of the operating lever 5. The canopy 24 cooperates with the second guide section 55, as will be explained below on the basis of other cross-sectional drawings.

It can also be seen that the outer surface 65 of the manual operating section 50 runs essentially parallel to the second busbar section 31 and/or the third busbar section 37, which will be explained below.

Figure 3:
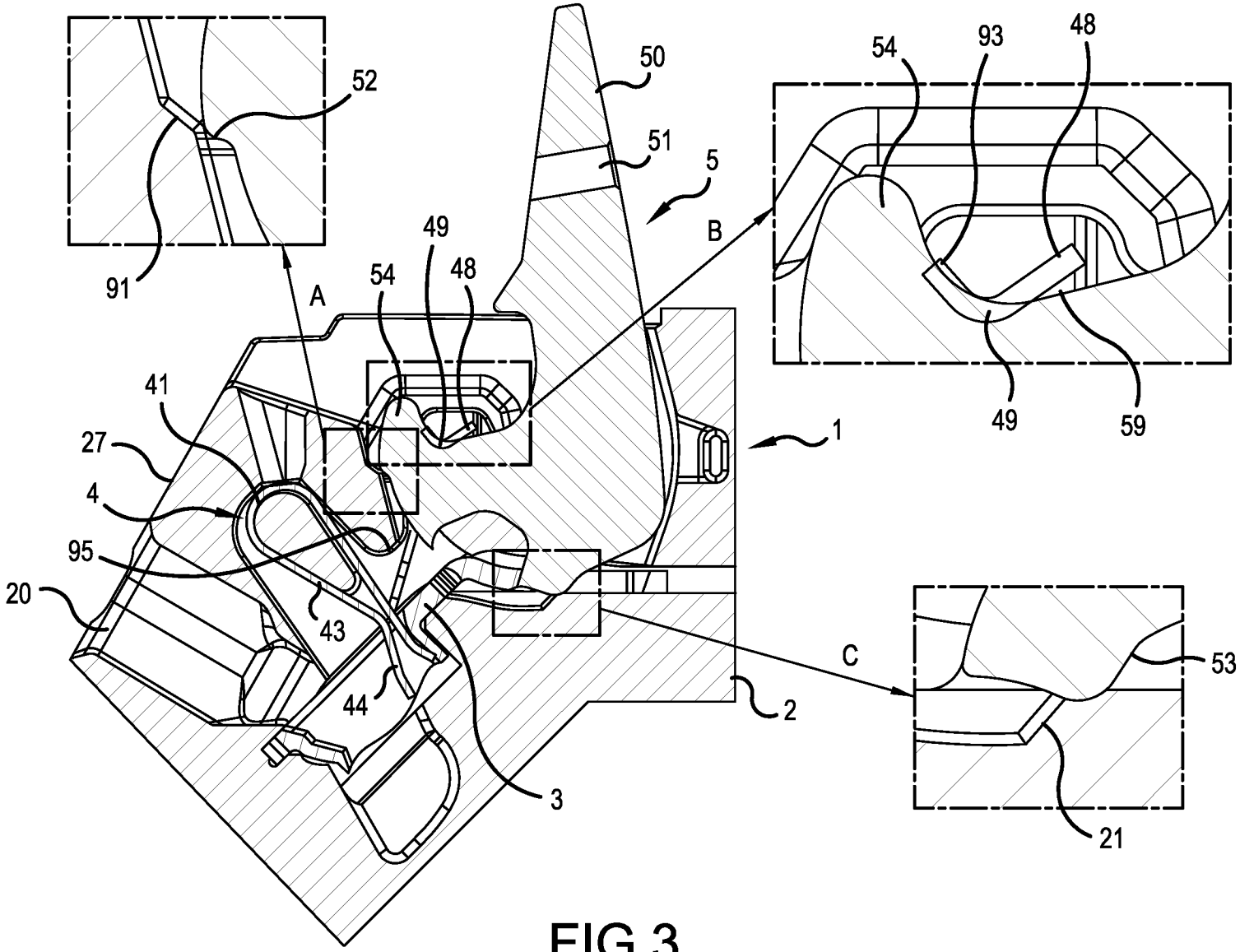
FIG. 3 shows the conductor connection terminal according to FIG. 1 in a sectional side view with the operating lever partially open.

First of all, the mode of operation of the operating lever 5 during a pivoting process will be explained with reference to FIG. 3, starting from the closed position shown in FIG. 1. In FIG. 3, the operating lever 5 is not yet completely in the open position, but just in front of it. While the spring driver 54 does not dip into the driver opening 46 in the closed position, the spring driver 54 then engages in the driver opening 46 when the operating lever 5 pivots from the closed position into the open position.

The enlarged detail A, B and C shown in FIG. 3 is intended to clarify some relevant elements of the operating lever 5 and their interaction with other elements of the conductor connection terminal 1.

It can be seen from the Illustration A that the first fixing element 52 is shortly before reaching the second latching edge 91. Likewise, as shown in Illustration C, the second fixing element 53 is just before reaching the first latching edge 21. The rear stop 94 of the operating lever 5 on the insulating housing 2 in the area of the outer surface of the insulating material housing now serves as a stop and a pivot point for the operating lever 5 in the further movement of the operating lever 5 so as to reach the open position according to FIG. 4. During this further movement, the spring driver 54 is initially moved essentially in a translatory manner along the second busbar section 31. As soon as the second fixing element 53 crosses the first latching edge 21, the operating lever 5 executes a "downward movement" by the spring force applied to the spring driver 54 that is essentially vertically oriented for translational movement.

The Illustration B shows how the operating arm 42 has been gripped at the end by the spring driver 54 and is guided on via the socket support 59. With regard to its shape, i.e. with regard to the concave inner contour, the socket support 59 is adapted to the convex outer contour of the bent support area 49, so that the bent support area 49 can slide within the socket support 59 with little friction. As the overall view of the conductor connection terminal in FIG. 3 shows, the operating arm 42 is deflected and accordingly, the clamping leg 43 is moved along with it, so that the clamping tongue 44 is moved from its original position shown in FIG. 1. It can also be seen that in the described construction, the effective load arm of the operating lever 5 is shortened during an opening movement, since the bent support area 49 slides along the socket support 59 and thereby approaches the virtual pivot axis of the operating lever 5.

FIG. 4 shows the operating lever 5 now in the open position, i.e. at the end of the pivoting movement. In this open position, the operating lever 5 can still be over-pivoted about a small pivoting angle, e.g. a maximum of 5 degrees or a maximum of 10 degrees, to be resistant to damage, but the actual open position is already reached in the position shown in FIG. 4. If the operating lever 5 is over-pressed, this over-pressing movement is limited by a rear stop 94 on the insulating material housing. In relation to the entire pivoting path or pivoting angle of the operating lever 5, the overbending angle range of the operating lever 5 amounts to a maximum of 5% of the entire pivoting angle range until the rear stop 94 is reached.

The operating lever 5 is located in each operating position, predominantly within the area surrounded by the outer contour 27 of the insulating material housing 2. In particular, the operating lever 5 is also in the open position in a substantial area of its longitudinal extent, not less than at least 30% or at least 40%, within the area surrounded by the outer contour 27 of the insulating material housing 2. In this way, the operating lever 5 is mounted in a particularly robust manner and therefore cannot be damaged so easily and/or cannot tilt so easily. A robust support of the operating lever 5 in the insulating material housing 2 is achieved.

As the enlarged detailed representations in the enlargements D and E show, the first fixing element 52 is now latched behind the second latching edge 91, and the second fixing element 53 is latched behind the first latching edge 21. The operating lever 5 in this case has in this case, i.e. in the transition from the position according to FIG. 3 to the position according to FIG. 4, in addition to the pure pivoting or rotating movement, also executed a sliding movement, that is, it has moved by a certain displacement path oriented along the second busbar section 31 towards the first clamping point 7 in order to lift a fourth fixing element 64 over the bent area 35 of the busbar 3 and then lower it into a dead center position vertically to the displacement movement, so that at least a part of the bent area 35 engages in the fourth fixing element 64 in a form-fitting manner. This displacement movement does not have to be carried out by the user but instead is caused by the stop 94 and the spring tension action with which the operating arm 42 impacts the operating lever 5. As can be seen in FIG. 4, the operating lever 5 is now securely held in this position by the pulling force exerted by the operating arm 42 pulling the operating lever 5 against corresponding support points 84, 85, which are respectively arranged to the left and right of the line of action of the pulling force, namely on the one hand a first support point 84, which is formed between the first fixing element 52 and the second latching edge 91, and on the other hand a second support point 85 in the region of the cutout F. This second support point 85 can be formed between the fourth fixing element 64 and a corresponding bent area 35 of the busbar.

With the opposite movement of the operating lever 5, i.e. from the open position to the closed position, the contact between the fourth fixing element 64 and the bent area 35 on the busbar 3 is eliminated at the second support point 85 by the second fixing element 53 sliding up over the first latching edge 21 (see also cutout C, FIG. 3). In this case, the operating lever 5 initially rotates about the first support point 84 between the first fixing element 52 and the second latching edge 91. Wear on the fourth fixing element 64 is thus avoided.

Thus, in the open position, the position of the operating lever 5 can be secured via a two-point support of the operating lever 5 on the insulating material housing 2 and/or the busbar 3 and the essentially central force application of the clamping spring 4 via the operating arm 42. This type of force transmission creates a kind of funnel shape of the force effects, by means of which the operating lever 5 is secured particularly reliably against undesired changes in position, for example due to vibrations.

Figure 4A:
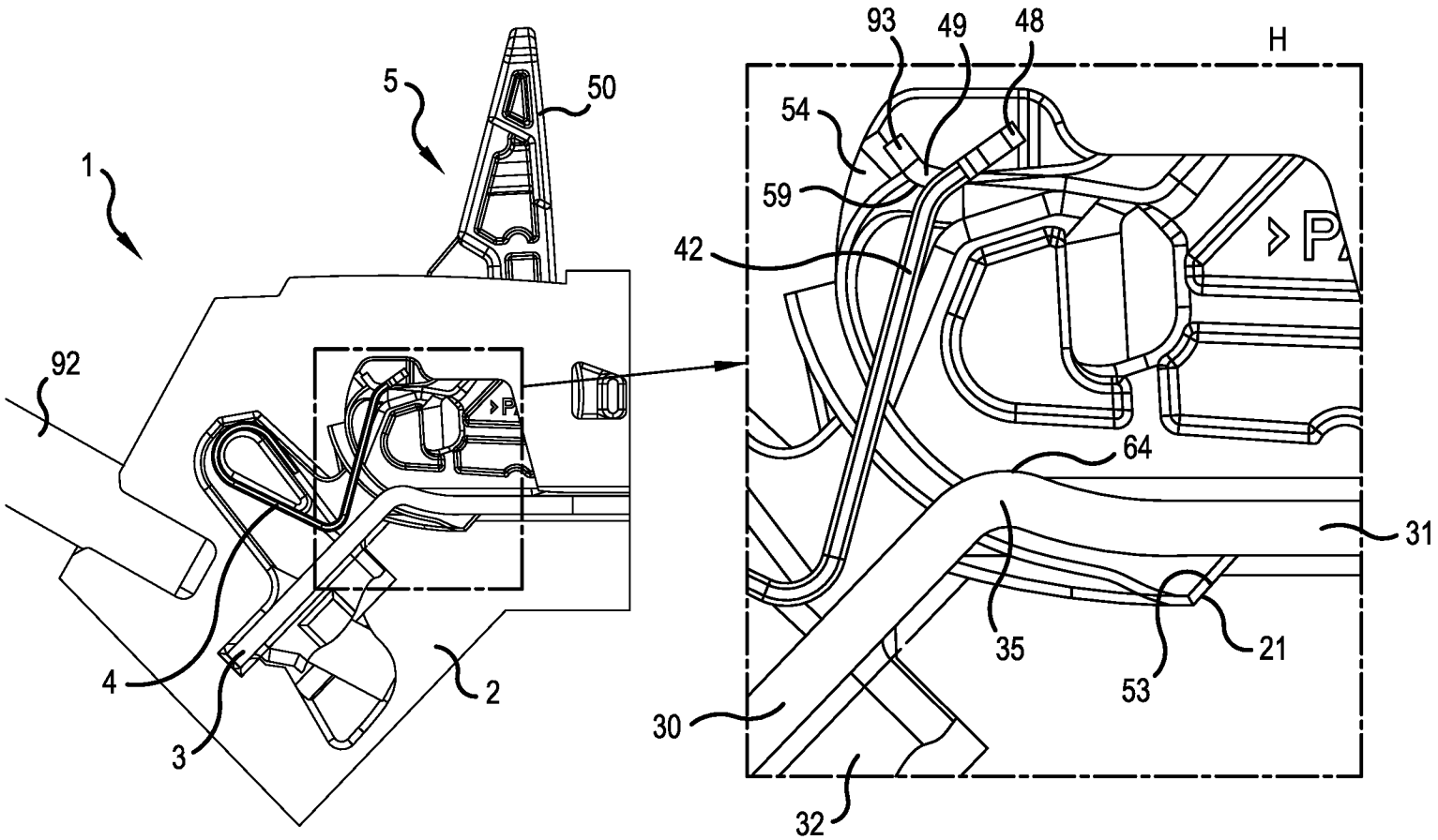
FIG. 4*a* shows the conductor connection terminal according to FIG. 1 in a side view in the open position.

FIG. 4*a* illustrates, in particular through the exploded cutout H, how the fourth fixing element 64 rests on the bent area 35 and is fixed there in a form-fitting manner. The second fixing element 53 projects through the recess 33 of the busbar 3, so that a part of the second fixing element 53 projects below the second busbar section 31 and can be seen there.

FIG. 4*a* also illustrates the support of the bent support area 49 of the operating arm 42 on the socket support 59.

FIG. 4 also shows that an electrical conductor 92 with an area stripped at the end is inserted into the conductor connection terminal 1 and the stripped area is arranged in the area of the first clamping point 7. If the operating lever 5 is now moved back into the closed position, the clamping leg 43 springs back until the clamping edge 45 rests against the stripped area of the electrical conductor 92 and presses it against the busbar 3, e.g. against the inside of the conductor lead-through opening 36 or the material passage 32.

Between the contact leg 40 and/or the spring arch 41 and an inner area of the insulating material housing 2, in which the second guide section 55 is arranged in the closed position and the spring driver 54 in the open position, there is a partition 26 of the insulating material housing 2, which has the second latching edge 91. This partition 26 provides an additional separation between the operating lever 5 and the electrical components, in particular the clamping spring 4.

Another positive aspect of this construction is that the partition 26 is in turn supported and counter-supported by the clamping spring 4 against the support force of the operating lever 5 at the first support point 84, since the clamping spring 4 in the area of the contact leg 40 and/or the spring arch 41 presses from the opposite side against the partition 26. In this way, a self-supporting system can advantageously be created. In addition, a plastic component is supported in this way against a metal component, which induces or introduces the force, which is advantageous when exposed to moisture that can lead to a reduction in the stability of the plastic material.

Figure 5:
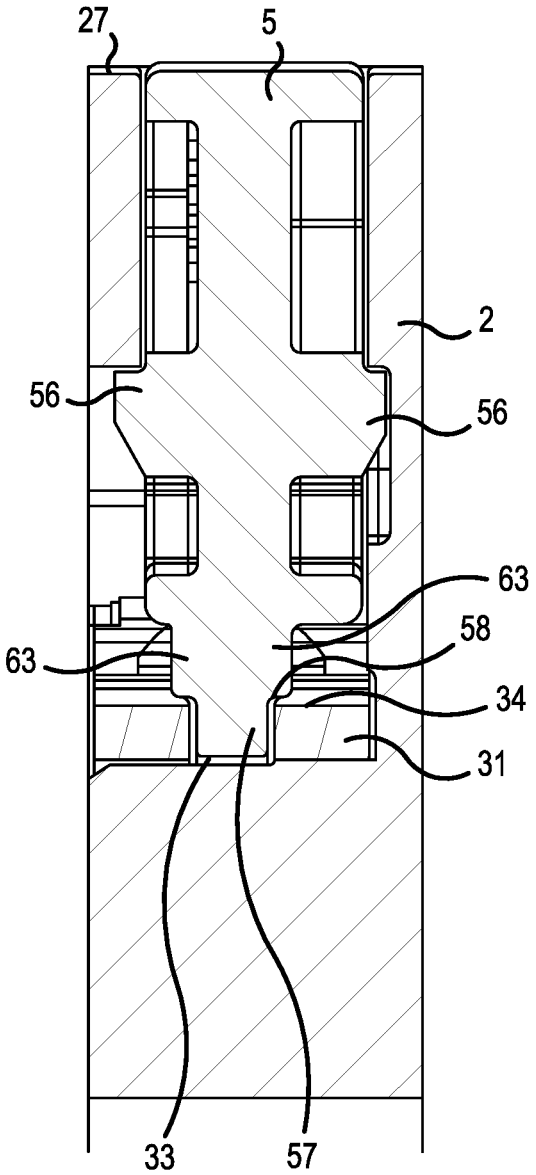
FIG. 5 shows the conductor connection terminal according to FIGS. 1 to 4 in the cutting plane F labeled in FIG. 4.
Figure 6:
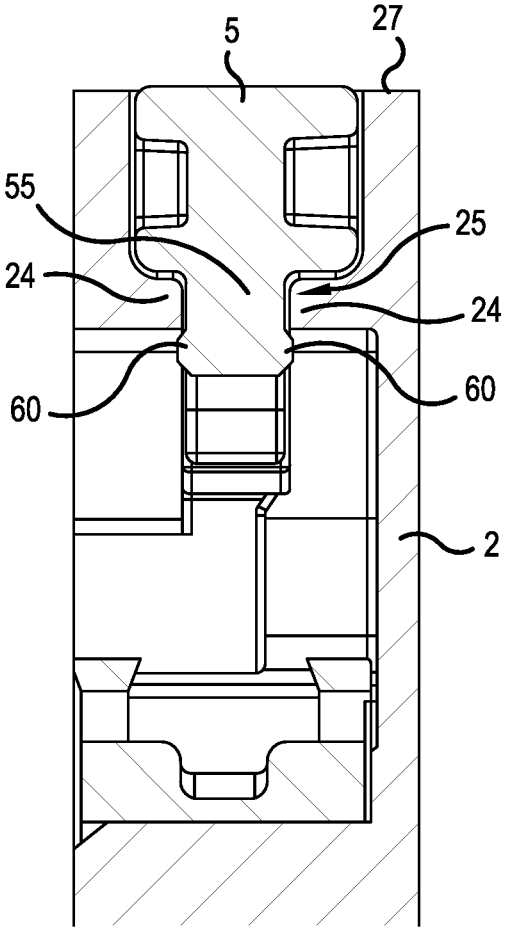
FIG. 6 shows the connection terminal according to FIGS. 1 to 4 in the sectional plane G labeled in FIG. 4.

FIG. 4 illustrates two sectional planes F and G. The corresponding sectional views are shown in FIGS. 5 and 6, wherein the operating lever 5 is in the closed position. As the sectional illustration of FIG. 5 in the sectional plane F shows, the operating lever 5 is arranged with its first guide section 57 in the recess 33 in the second busbar section 31 and is guided longitudinally therein. For additional guidance and mounting, the operating lever 5 has laterally projecting support elements 56 which can be designed like support journals. However, via these lateral support elements 56, the operating lever 5 is not fixedly mounted about an unchangeable axis of rotation, but rather can be displaced to a certain extent. In this way, the operating lever is mounted to be "floating" in the insulating material housing 2.

It can also be seen that the operating lever 5 is supported by laterally projecting shoulder-shaped support projections 58 on the upper side of the busbar 3, in particular in the second busbar region 31. In particular in the open position, the support projection 58 can form a support point for the operating lever 5 on the busbar 3, wherein the support point can be arranged in the bent area 35.

The first fixing element 52 can also run along an inner guide contour of the insulating material housing during a pivoting movement of the operating lever 5, for example during a pivoting movement from the open position into the closed position. In this case, the contact between the support projection 58 on the operating lever 5 and the support area 34 can be eliminated, which is used to support the movement of the operating lever 5 in the direction of the open position, wherein the operating lever 5 is lifted from the busbar 3. Among other things, this also serves to reduce wear or abrasion on the operating lever 5.

FIG. 5 shows that, in the closed position, the operating lever 5 does not project or substantially does not project beyond the outer contour 27 of the insulating material housing 2.

FIG. 6, with the sectional illustration in the sectional plane G, illustrates the fixing of the operating lever 5 in the closed position. The operating lever 5 has the second guide section 55 projecting downward on the manual operating section 50, which at least in this position of the operating lever 5 extends through the lever lead-through slot 25 in the canopy 24. On the second guide section 55, laterally projecting third fixing elements 60 are arranged, for example, formed integrally on the second guide section 55, which in the closed position engage behind the underside of the edge portions of the canopy 24 and in this way fix the operating lever 5. The canopy 24 can be formed by projections inwardly projecting from opposite side walls of the insulating material housing 2.

In the open position, the lever lead-through slot 25 is largely closed by the area of the operating lever 5 that has the spring driver 54, so that protection against contact is also ensured in this position.

Generally speaking, there is an opening in the insulating material housing 2, such as the lever lead-through slot 25, which is covered by the operating lever 5 in the closed position of the operating lever 5 and is thus shielded from the outside environment, wherein the opening leads to electrically active components arranged in the insulating material housing 2 such as the clamping spring 4 or busbar 3, and the spring driver 54 in the open position of the operating lever 5 at least partially closes this opening, at least to the extent that contact protection is provided.

Figure 8:
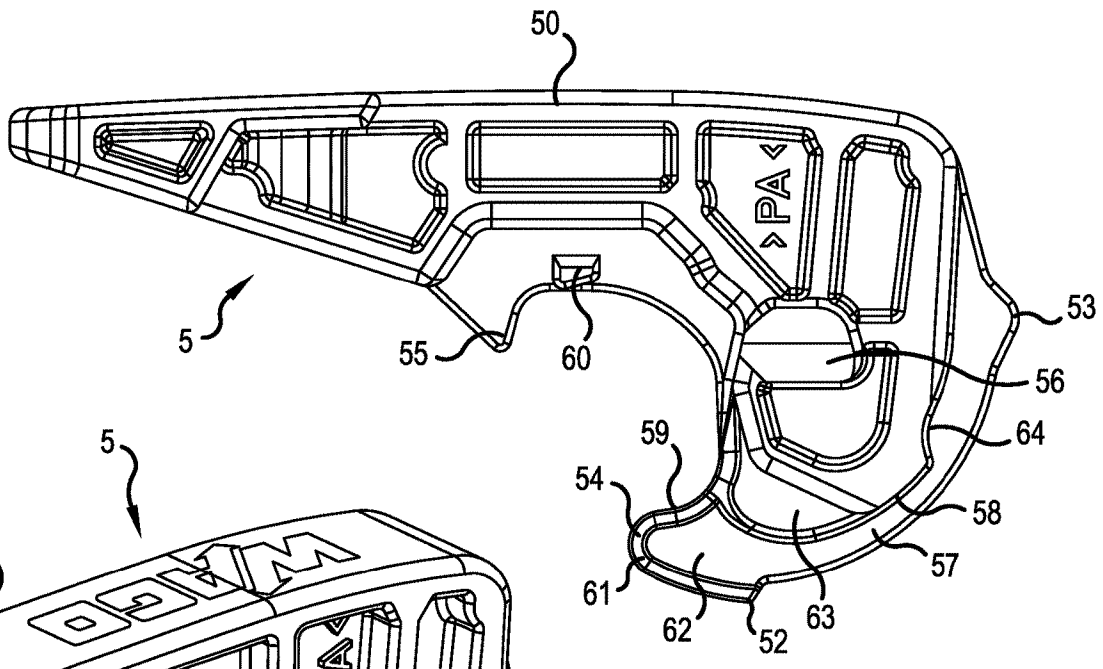
FIG. 8 shows the operating lever according to FIG. 7 in a side view.
Figure 9:
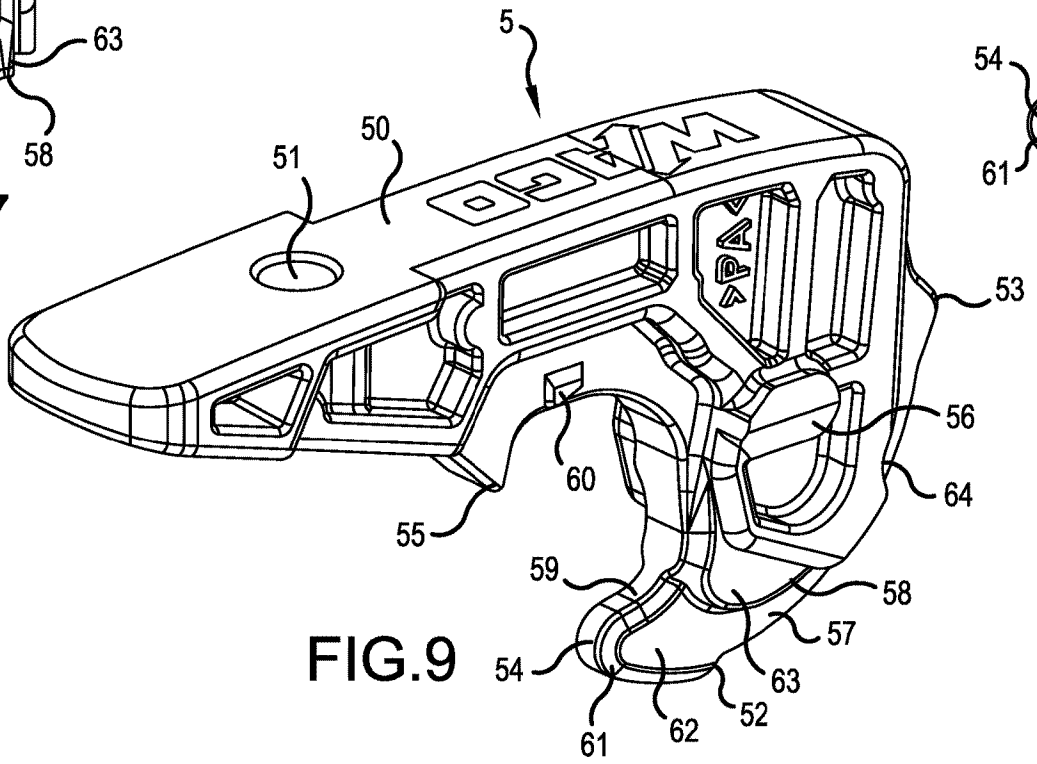
FIGS. 9 and 9*a* show the operating lever according to FIGS. 7 and 8 in a perspective view.
Figure 7:
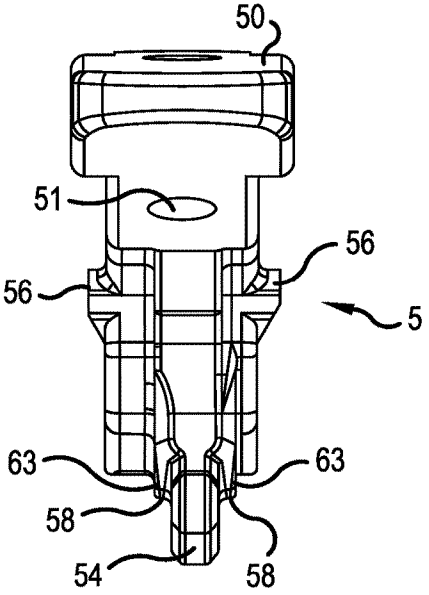
FIG. 7 shows an operating lever in a front view.

The previously explained elements of the operating lever 5 are also illustrated by the various representations in FIGS. 7 to 9, which show the operating lever 5 in a separate representation. What can be seen in particular is that the operating lever 5 does not have to be formed exactly symmetrical to a pivoting plane of the operating lever 5. Instead, as illustrated in FIG. 7, the spring driver 54 and the first guide section 57 connected thereto can be arranged eccentrically, for example slightly offset to the side. In order to optimize the assembly of the individual parts, in particular the operating lever 5 in the conductor connection terminal 1, the spring driver 54 itself can also be asymmetrical, e.g. taper asymmetrically towards the end on one side.

Figure 9A:
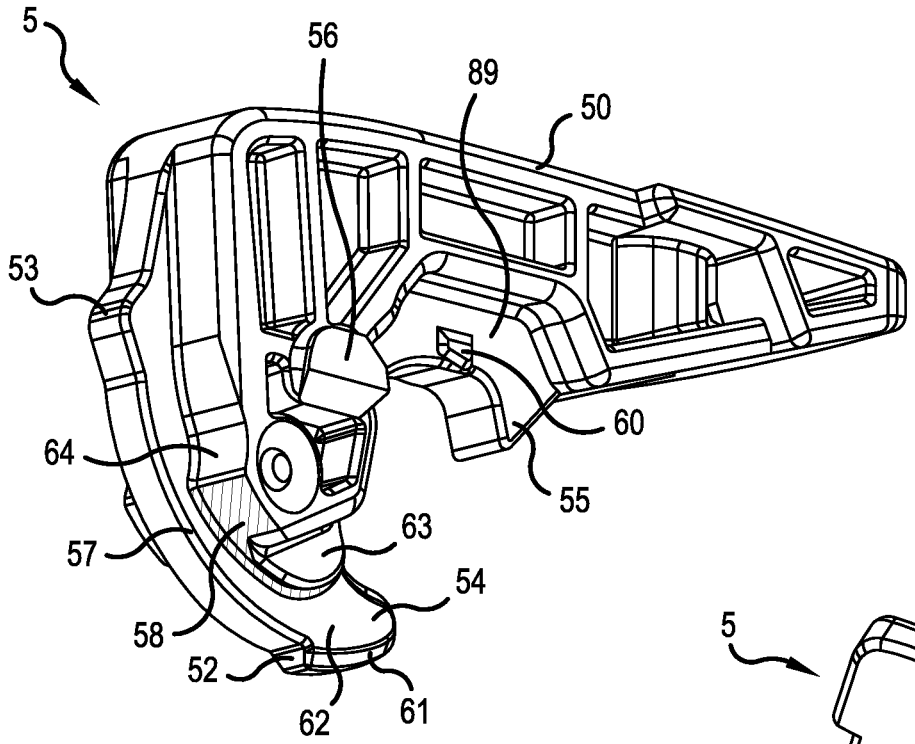

FIG. 9*a* shows the operating lever 5 in a view in which the support projection 58 can be clearly seen. The support surface formed by the support projection 58 is shown hatched for clarity in FIG. 9*a*.

As is also made clear, the operating lever 5 can be designed as a material and weight-optimized component with a series of recesses that are interrupted by reinforcing walls and in this way ensure the necessary robustness and rigidity of the operating lever for the operating movements. The operating lever 5 can, for example, be made in one piece as a plastic component, e.g. as an injection-molded part.

FIG. 9*a* also shows that the operating lever 5 can have lateral recesses 89. The lateral recesses 89 can be arranged, for example, in the area of the second guide section 55 and/or the third fixing element 60. In the closed position, the canopy 24 can be at least partially received in these lateral recesses 89.

Figure 9B:
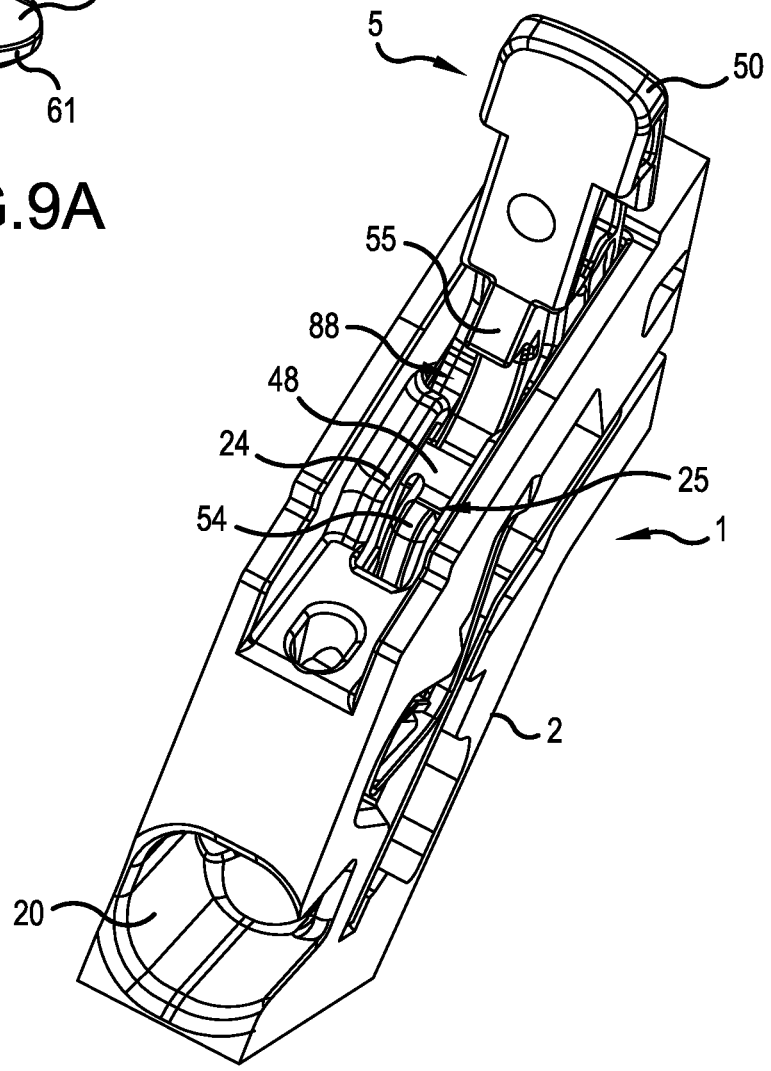
FIG. 9*b* shows the conductor connection terminal according to FIG. 1 in a perspective view in the open position.

FIG. 9*b* shows the conductor connection terminal 1 in the open position of the operating lever 5. As already mentioned, the lever lead-through slot 25 in the canopy 24 is at least largely closed in this open position.

FIG. 9*b* also shows that the insulating material housing 2 can have a lever opening 88, which allows for installation of the operating lever 5 in the final assembled insulating material housing 2. With the insulating material housing 2 fully assembled, the operating lever can be mounted, so to speak, from above through the lever opening 88.

The lever opening 88 can be completely surrounded on the circumference by the material of the insulating material housing 2, i.e. by corresponding walls or other sections of the insulating material housing 2.

Figure 9C:
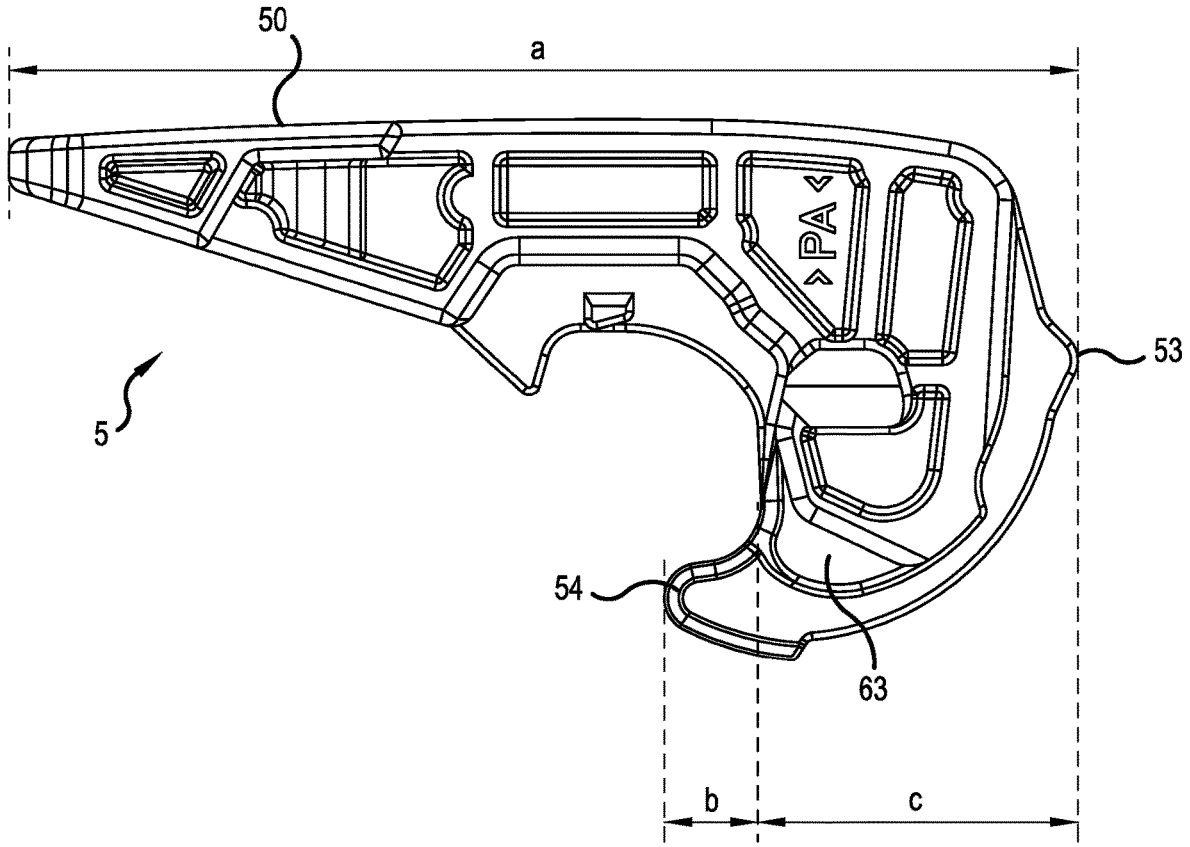
FIG. 9*c* shows the operating lever according to FIG. 7 in a side view.

FIG. 9*c* illustrates the particular proportions that the operating lever 5 can have according to the invention. In the longitudinal direction of the operating lever 5, i.e. in the direction a, the operating lever 5 has the length a. In the rear area, the operating lever 5 has its support area, which includes the third area 63, for example. The operating lever 5 is mounted in the insulating material housing 2 in this support area. The mounting area has a length c in the longitudinal direction. Furthermore, FIG. 9*c* shows the length b of the spring driver 54, which extends from the root region of the spring driver 54, which is adjacent to the third area 63, to the free end in the longitudinal direction of the operating lever 5. The ratio b/c can be, for example, at least 0.2 or at least 0.25 or at least 0.3. The ratio b/a can, for example, be at least 0.07 or at least 0.08 or at least 0.09.

Figure 10:
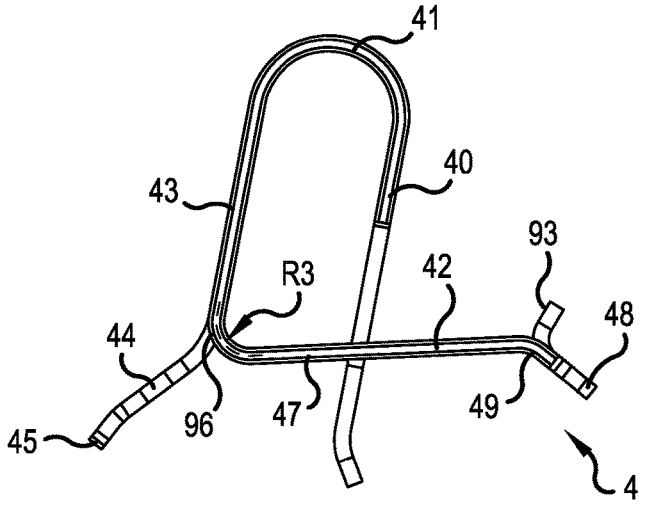
FIG. 10 shows a clamping spring in a side view.
Figure 11:
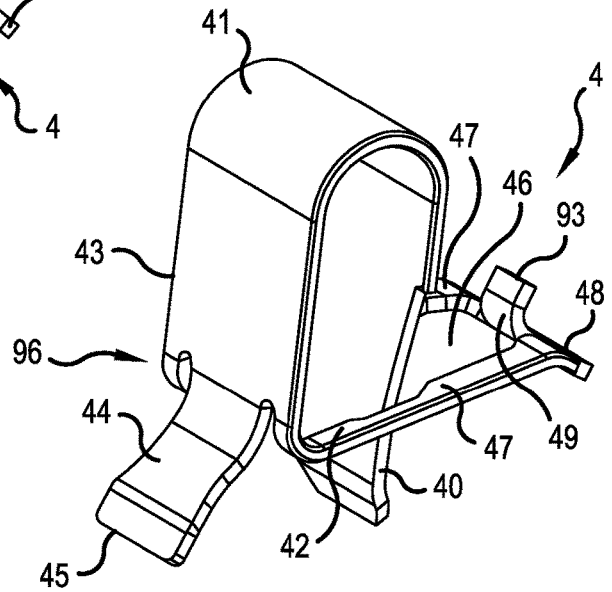
FIG. 11 shows the clamping spring according to FIG. 10 in a perspective view.

FIGS. 10 and 11 show the clamping spring 4 in a separate illustration. This also makes it clear that the clamping spring 4 has a root region 96 on the clamping leg 43, on which the clamping leg 43 branches into the clamping tongue 44 and the operating arm 42. As can be seen, the operating arm 42 is designed with a relatively large recess which forms the driver opening 46. Starting from the clamping leg 43, only two relatively thin side webs 47 extend to the left and right of the contact leg 40. The side webs 47 can be made very thin, since they transmit a pure tensile force. The contact leg 40 also extends through the recess. The operating arm 42 can be produced from the same material together with the clamping tongue 44 by separating the clamping tongue 44 from the material of the operating arm 42, for example by means of a punching process. Since the side webs 47 can be so narrow, this leaves a relatively wide central material section for forming the clamping tongue 44 so that a relatively wide clamping edge 45 can be provided. This is beneficial for good electrical contact and secure clamping of an electrical conductor. In addition, high elasticity of the operating arm 42 is achieved by such narrow side webs 47. In this way, the operating arm 42 is connected to the clamping leg 43 in a relatively pliable manner.

Since the side webs 47 can be designed like "thin legs", they act like a type of flexible connecting element, i.e. like a thread or rope connection when subjected to tensile load. A relatively small bending radius R3 at the transition from the operating arm 42 to the clamping leg 43 or the narrow bend formed thereby causes a stiffening in this area, so that the side webs 47 are quasi stretched under the tensile load that occurs and experience almost no elastic deformation in the form of a deflection.

The clamping spring 4 can be designed in one piece with all the features described, that is to say made integrally from a flat sheet of metal, e.g. punched from a sheet metal with a predetermined thickness and bent.

It can also be seen in FIG. 11 that the material width of the side webs 47 can vary over their longitudinal extent. For example, there may be a gradation or a transition from an initially narrower region starting from the clamping leg 43 to a region of the side webs 47 that is wider towards the transverse web 48. The wider area of the side webs 47 is particularly effective with a higher spring load. In this case, the inner distance between the side webs 47 in the area of the driver opening 46, in which the contact leg 40 projects through the driver opening 46, can be greater than in the area of the driver opening 46, which is used to receive the spring driver 54.

The clamping tongue 44 can in particular be trapezoidal or can become narrower towards the free end. This has the advantage that if the clamping spring 4 is positioned at an angle, the clamping spring 4 does not block on the inner side surfaces of the material passage 32.

The operating arm 42 has the transverse web 48 at the end. A bent tab 93 projects from the transverse web 48. On the underside, i.e. on the side facing the driver opening 46, the tab 93 forms the bent support area 49 for resting on the socket support 59 of the operating lever 5. The operating arm 42 can be produced in the end area in such a way that the area with the transverse web 48 is bent in a first bending direction from the side webs 47 and the tab 93 is bent from the transverse web 48 in another, opposite bending direction. In this way, while avoiding excessive degrees of deformation, a relatively large angle exceeding 90 degrees can be achieved between the tab 93 and the side webs 47.

Accordingly, the operating arm 42 has two side webs 47, which are spaced apart from one another and which are connected to one another at their free end via the transverse web 48. The side webs 47 and the transverse web 48 enclose the driver opening 46, which is used to engage the spring driver 54. The tab 93, which points into the driver opening 46 and has a bend, adjoins the transverse web 48 so that this bend forms a bent support area 49 on its convex surface, which is designed for contact with the socket support 59 of the operating lever 5.

Accordingly, the free end of the operating arm 42 is bent away from the spring arch 41 with the transverse web 48. The curvature or rounding of the bent support area 49 is adapted to the shape of the socket support 59 in terms of shape.

It can also be seen that the operating arm 42 branches off from the clamping leg 43 relatively far at the end of the clamping leg 43, but at the very least closer to the clamping edge 45 than on the spring arch 41. The operating arm 42 thus runs at a minimal distance from the busbar 3 (also see FIG. 1) in the assembled and non-actuated state. The operating arm 42 accordingly runs predominantly essentially parallel to the surface of the first busbar section 30. In this way, a relatively large lever arm for operating the clamping leg 43 is realized. As a result, the operating force of the operating lever 5 can be reduced. The operating arm 42 can extend along the first busbar section 30 to beyond the bent area 35. The operating arm 42 can in particular project with its driver opening 46 beyond the first busbar section 30, so that the spring driver 54 can engage in the driver opening 46 through the busbar 3 without hindrance.

The clamping spring 4 can be designed to be particularly elastic. This configuration also prevents the clamping spring from tilting significantly in the event of a diagonal pull.

The operating arm 42 can also be guided by guide means in the insulating material housing, for example, an inner housing wall or housing edge, in the longitudinal direction of the operating arm 42. Such an inner housing edge is formed, for example, by the free end of the intermediate wall 26 extending into the interior of the insulating material housing 2 (see also FIGS. 3 and 4). In this way, a bending load at the transition from the operating arm 42 to the clamping leg 43 can be further minimized. In addition, this allows for the bent support area 49 in the socket support 59 to be advantageously guided during a pivoting movement of the operating lever 5 by guiding the bent support area 46 in the socket support 59 in the direction of a pivoting axis of the operating lever 5. In this way, a clamping spring 4 with a shortened buckling length can be realized. Such a clamping spring 4 is better protected against undesired bending or kinking of the clamping leg 43 when a clamped electrical conductor is pulled from the outside. The risk of the clamping leg 43 buckling when mechanically pulling on a jammed electrical conductor is minimized.

The distance, that is to say the gap between the operating arm 42 and the busbar 3, can for example be less than 1 mm, or less than 0.5 mm. An exemplary advantageous value is 0.3 mm. In this way, the operating arm 42 does not yet touch the busbar, so that wear due to friction is avoided.

According to an advantageous embodiment, the effective length of the operating arm 42 with regard to the actuation, measured from the junction of the operating arm 42 from the clamping leg 43 to the bent support area 49, is greater than the length of the clamping leg, measured from the junction of the operating arm 42 from the clamping leg 43 to the vertex of the spring arch 41. In this way, a spring with a short buckling length and favorable operating forces can be realized.

Figure 12:
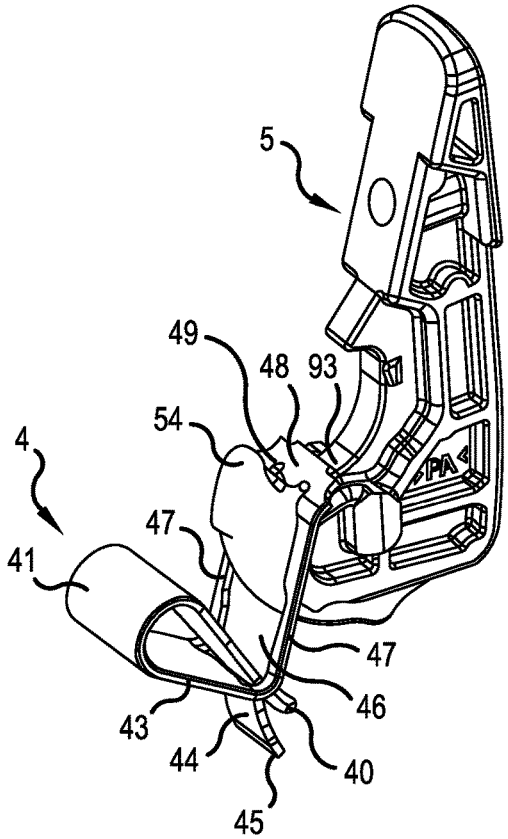
FIG. 12 shows an arrangement of the operating lever according to FIGS. 7 to 9 and the clamping spring according to FIGS. 10 to 11 in a perspective view.

FIG. 12 shows the interaction between the clamping spring 4 and the operating lever 5 when the operating lever 5 is in the open position. The spring driver 54 projects through the driver opening 46. The advantageous interaction of the bent support area 49 with the socket support 59 can again be seen.

As FIGS. 7 to 9 also show, the spring driver 54 has a width that changes over its extension. This can, e.g., be realized in that the spring driver 54 is narrower towards its free end, for example by a one-sided or two-sided bevel. A first area 61 and a second area 62 adjoining the first area 61 can thus be formed on the spring driver 54. The first area 61 is narrower in the direction of the width of the spring driver 54 than the second area 62. The spring driver 54 can then merge into a third area 63 which is wider than the second area 62. In this way, the spring driver 54 can easily be inserted into the driver opening 46. If the spring driver 54 is inserted with its first area 61 into the driver opening 46, a guide for the side webs 47 of the operating arm 42 can be formed by the second area 62 and/or the third area 63 that follows when the operating lever 5 is pivoted further. The guide can in particular be designed as a guide on both sides for both side webs 47. This embodiment of a spring driver 54 is suitable not only for an operating lever 5 with the pivotability described, but also for operating elements of different types that are mounted displaceably, i.e. that are designed in the form of a sliding element.

It can also be seen that the operating arm 42 essentially does not change its position with respect to the clamping leg 43 in the course of the operating movement of the operating lever 5. This has the advantage that the transition point between the operating arm 42 and the clamping leg 43 is only exposed to slightly changing bending loads during use. This is further supported by a comparatively small bending radius at the transition from the operating arm 42 to the clamping leg 43. For example, a mean bending radius R3 of this bending area, which is at most three times the thickness of the sheet metal, is favorable. This enables the force of the operating lever 5 to be optimally introduced into the clamping spring 4 via the operating arm 42. This results in direct transmission, a short stroke and, as a result, essentially no stretching in the operating arm 42. In addition, such a construction allows for the components used and the entire conductor connection terminal 1 to be manufactured easily.

The clamping spring 4 can thus be arranged with its predominant parts and in particular with the operating arm 42 on one and the same side of the busbar 3, in particular on the side from which an electrical conductor is inserted into the conductor lead-through opening 36.

Figure 13:
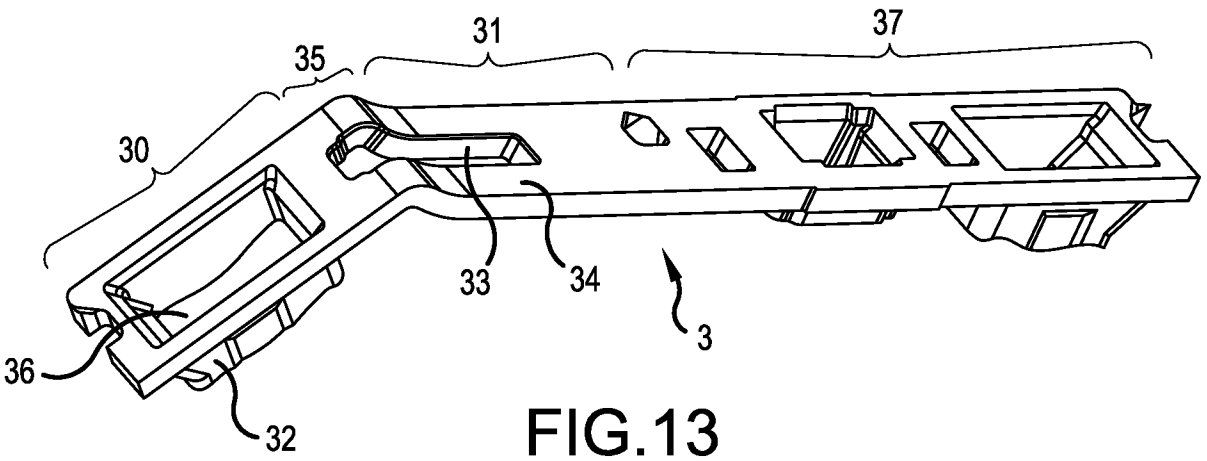
FIG. 13 shows a busbar in a perspective view.
Figure 14:
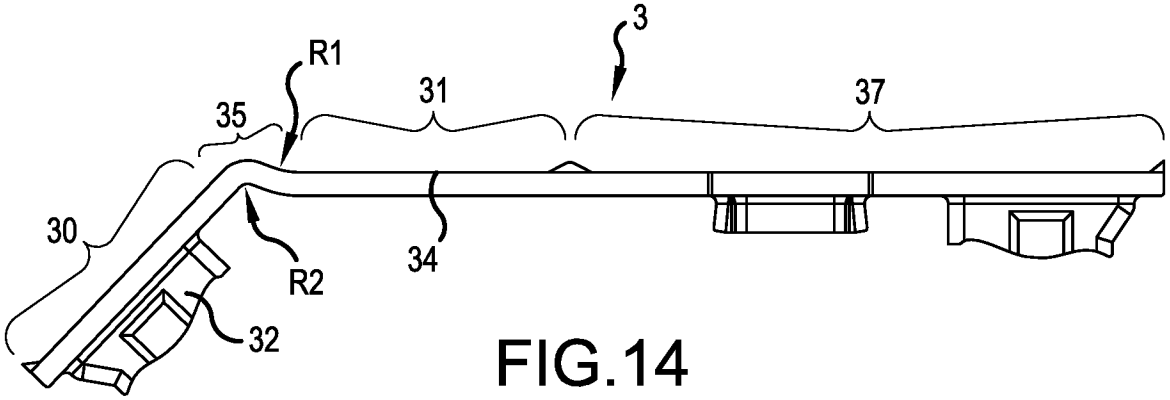
FIG. 14 shows the busbar according to FIG. 13 in a side view.

FIGS. 13 and 14 show the busbar 3 in a separate representation. In this case, the busbar 3 is also shown with a third busbar section 37 adjoining the second busbar section 31. In the third busbar section 37, the busbar 3 has further conductor lead-through openings at which further clamping points can be formed.

The first and second busbar sections 30, 31 have the elements already described. In particular, the recess 33 for guiding the first guide section 57 and the support areas 34 for supporting the support projections 58 of the operating lever 5 can be seen. The recess 33 can be arranged only in the second busbar section 31 or, as shown, also extend into the bent area 35 or even as far as the first busbar section 30. The recess 33 is enclosed on all sides by the material of the busbar 3. It can be designed as a recess that only partially penetrates the material of the busbar from the side of the support area 34 or as a completely continuous recess (without a bottom).

The busbar 3 is angled and/or bent by the bent area 35, i.e. in such a way that an angle is formed between the first busbar section 30 and the second busbar section 31. The bent area 35 can form an interior angle between the first busbar section 30 and the second busbar section 31 in a range from 105 to 165 degrees or 120 degrees to 150 degrees. The bent area 35 can be designed, for example, in such a way that the busbar 3, starting from the second busbar section 31, is initially bent concavely with a first radius R1 and then merges into a convex bent section with a radius of curvature R2, in each case in one viewing direction onto the support area 34. It is advantageous if the radius R1 is larger than the radius R2, for example, at least twice as large.

In this way, the operating lever 5 can at least partially also be supported on the bent area of the busbar 3, i.e. in the bent area 35, and can run along it during a pivoting movement.

As an alternative to the one-piece design exemplified thus far, the busbar 3 described can also be designed as a multi-piece design, e.g. with two or more separate busbar sections. In particular, the third busbar section 37 can be designed as a separate busbar section from the first and second busbar sections 30, 31. This is, e.g., advantageous for use in a disconnect terminal.

Figure 15:
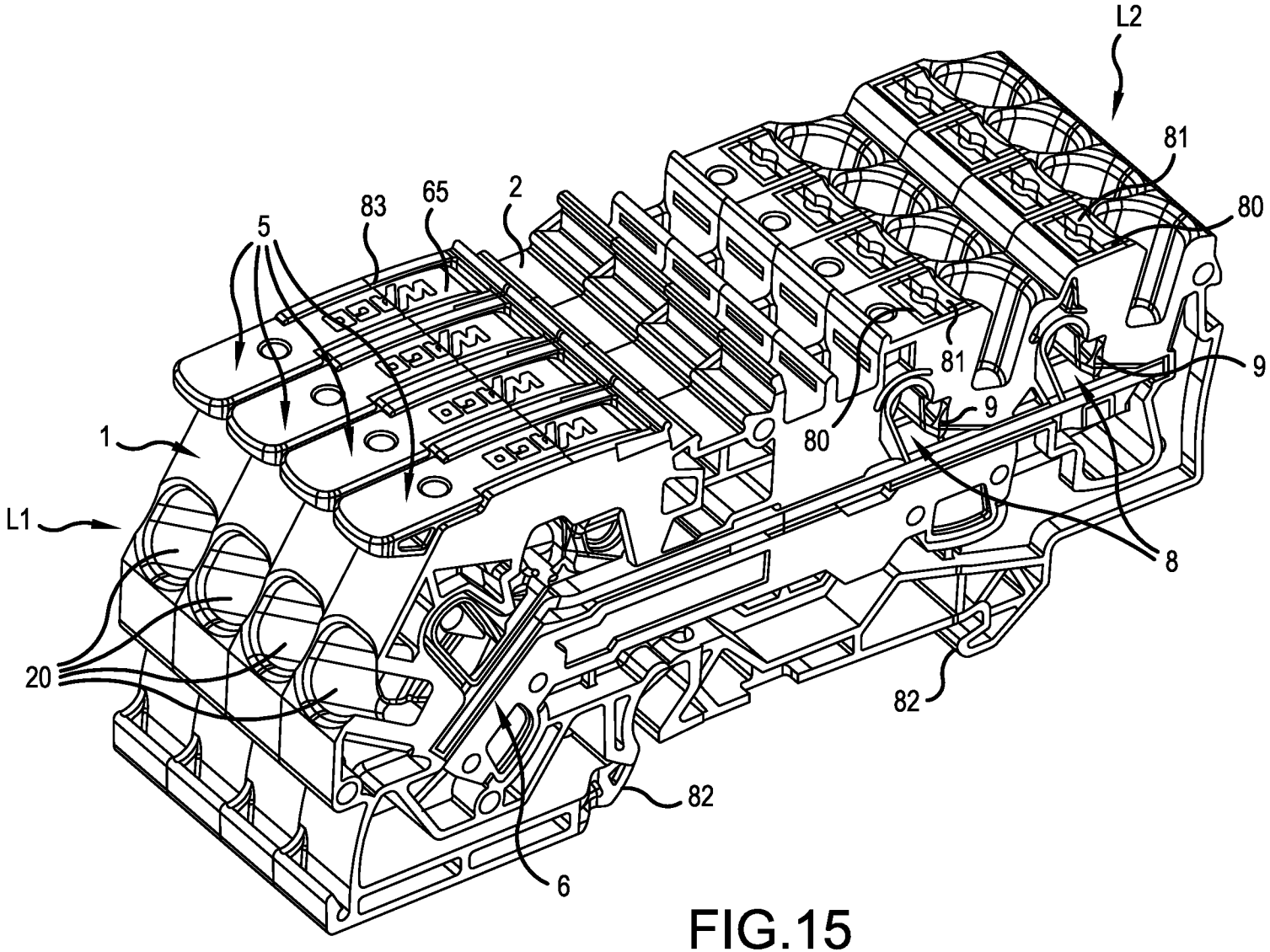
FIG. 15 shows a hybrid terminal block in a perspective view.

FIG. 15 shows a further embodiment of a conductor connection terminal 1, in this case in the form of a terminal block, wherein four conductor connection terminals 1 lined up next to one another are shown as an example. The conductor connection terminals 1 have the structure described above in the area visible on the left, i.e. the arrangement with the busbar 3, the clamping spring 4 and the operating lever 5 in the insulating material housing 2. In this case, the busbar 3 is designed in accordance with the embodiments of FIGS. 13 and 14, i.e. it has the third busbar section 37. The third busbar section extends into an area of the respective conductor connection terminal 1 shown on the right, in which at least one second conductor connection 8 with a second clamping point 9 is arranged in each case. In the exemplary embodiment shown, each conductor connection terminal 1 has two second conductor connections 8 and, accordingly, two second clamping points 9. The respective second conductor connection 8 is accessible via further conductor insertion openings formed in the insulating material housing 2. An electrical conductor can be inserted into the second conductor connection 8 in a conductor insertion direction L2. The conductor insertion direction L1 can be different from the conductor insertion direction L2.

The conductor connection terminals 1 have support rail fastening elements 82 with which the respective conductor connection terminal 1 can be fastened to a support rail, for example by snapping it onto the support rail. Relative to a fastening plane of the conductor connection terminal 1 defined by the support rail, the conductor insertion direction L1 can be arranged, for example, in a range of 30 degrees to 60 degrees to the fastening plane, and the conductor insertion direction L2 in an angular range of 75 to 105 degrees.

The support rail fastening elements 82 are arranged on a support rail fastening side of the insulating material housing 2. The operating levers 5 can be seen on the housing side of the insulating material housing facing away from the support rail fastening side, which is also referred to as the housing upper side 83. Here, the outer surface 65 of the manual operating section of the operating lever 5 in the closed position has the same course as the adjacent surface contour of the insulating material housing, i.e. the adjacent parts of the housing top side 83.

The conductor connection terminal 1 in the area of the second conductor connection 8 can be actuated by a further operating element 81, which can be arranged either as part of the conductor connection terminal 1, e.g. in the form of a pusher, in an operating opening 80 of the insulating material housing 2, or can be implemented by a separate operating tool that can be guided as needed through the operating opening 80 to the second conductor connection 8, but which is not part of the conductor connection terminal 1.

Figure 16:
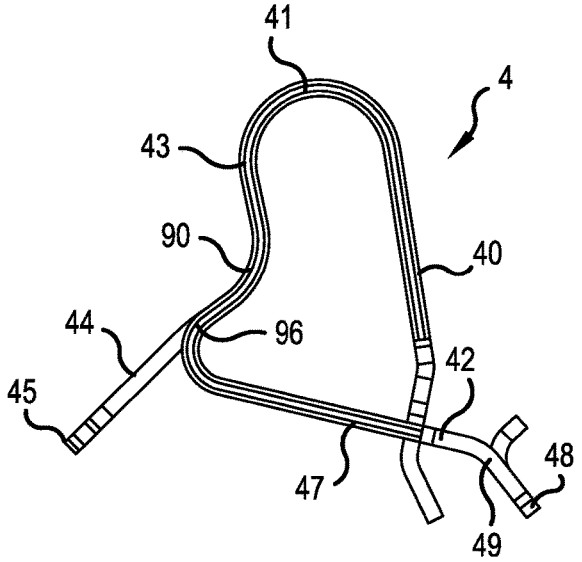
FIG. 16 shows a further embodiment of a clamping spring in a side view.
Figure 17:
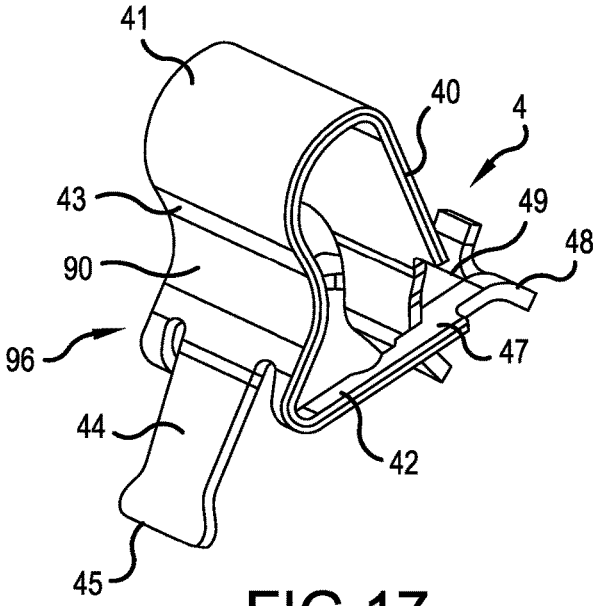
FIG. 17 shows the clamping spring according to FIG. 16 in a perspective view.
Figure 18:
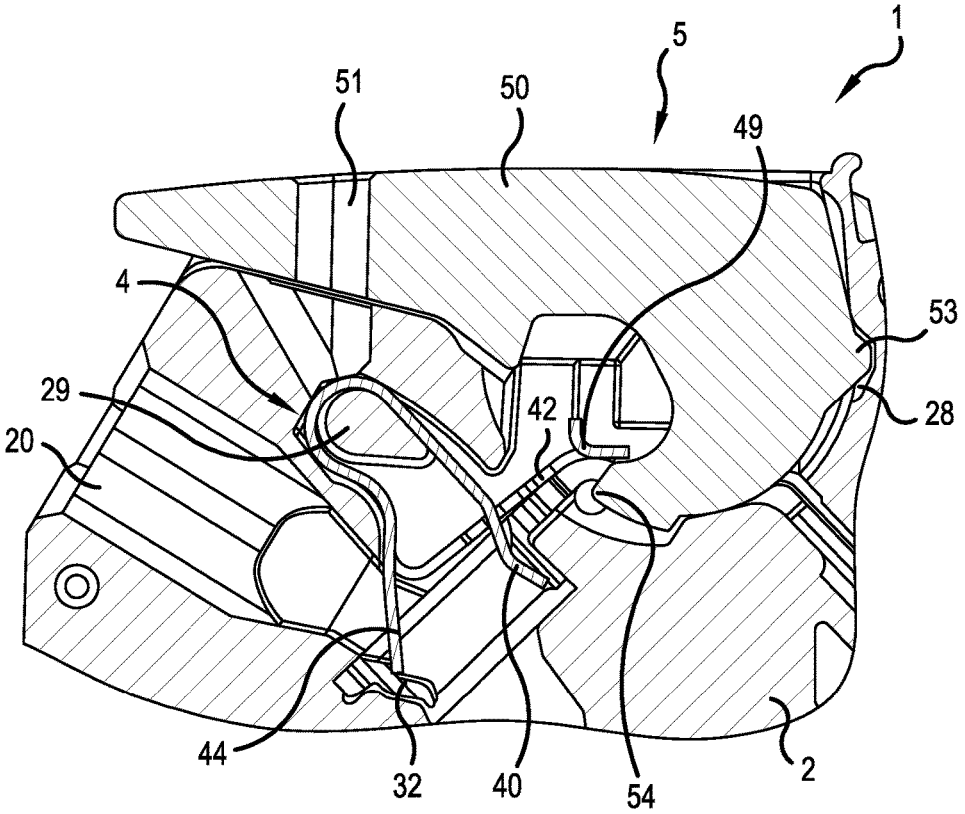
FIG. 18 shows a conductor connection terminal in a view comparable to FIG. 1 and a clamping spring according to FIGS. 16 to 17.

A further embodiment of the clamping spring 4 and a conductor connection terminal 1 formed therewith are shown using FIGS. 16 to 18. In contrast to the previously outlined embodiments, the clamping spring 4 has an additional arcuate area in the area of the clamping leg 43, which is referred to as the clamping leg arch 90. In the area of the clamping leg arch 90, the clamping leg 43 is bent towards the inner area of the space enclosed by the clamping spring 4. The overload protection element 29 of the insulating material housing 2 is adapted to the clamping leg bend 90. By means of the clamping leg arch 90, a shortened buckling length of the clamping leg 43 is achieved when the area of the clamping leg 43 between the clamping leg arch 90 and the spring arch 41 rests against the overload protection element 29. Thus, when the operating lever moves from the closed position into the open position, the clamping leg arch 90 strikes the overload protection element 29.

It can also be seen that the clamping spring 4 according to FIGS. 16 and 17 can have a different design of the clamping tongue 44, e.g. with an initially decreasing width towards the clamping edge 45, which becomes larger again in the end section so that a relatively wide clamping edge 45 can be provided with little material. Alternatively, the clamping spring 4 can also have a clamping tongue 44, as shown in FIGS. 10 and 11.

Figure 19:
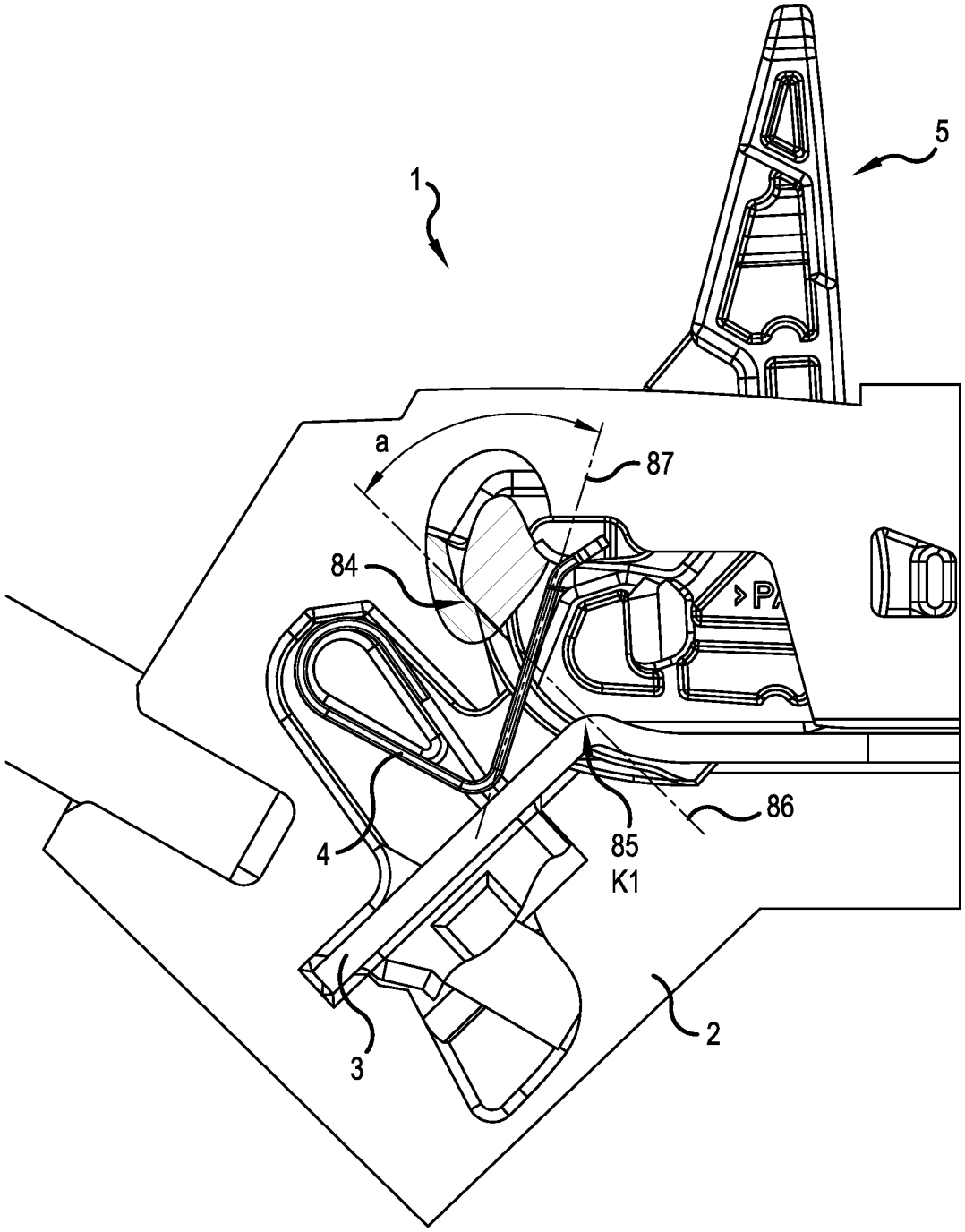
FIG. 19 shows another side view of the conductor connection terminal according to FIG. 4.

FIG. 19 shows the conductor connection terminal 1, which was already explained above with reference to FIGS. 1 to 4, in a representation similar to FIG. 4, but with different sectional planes. In the conductor connection terminal 1 shown in FIG. 19, the operating lever 5 is again in the open position. The operating lever 5 is supported on the first support point 84 and the second support point 85. The first support point 84 is formed between the first fixing element 52 of the operating lever 5 and the second latching edge 91;

the second support point 85 is formed between the fourth fixing element 64 of the operating lever 5 and the bent area 35 of the busbar 3.

A straight connecting line 86 is shown in FIG. 19, which runs through the first support point 84 and the second support point 85. A straight line 87 also shows the effective direction of the tensile force acting on the operating lever 5 by the clamping spring 4, which is transmitted via the operating arm 42. The direction of the line of action 87 corresponds to the direction of the operating arm 42 or the direction of the side webs 47 of the operating arm 42. It can be seen that an angle $\alpha$ is formed by the operating arm 42 or the line of action 87 to the straight connecting line 86. The angle $\alpha$ is thus defined in a mathematically positive direction from the line of action 87 or the direction of the operating arm 42 to the straight connecting line 86. The angle $\alpha$ is advantageously less than 90 degrees. This results in an advantageous funnel shape of the line of action 87 of the tensile force or the direction of the operating arm 42 as compared to the support plane that is formed by the first support point 84 and the second support point 85 (shown by the connecting line 86).

Figure 20:
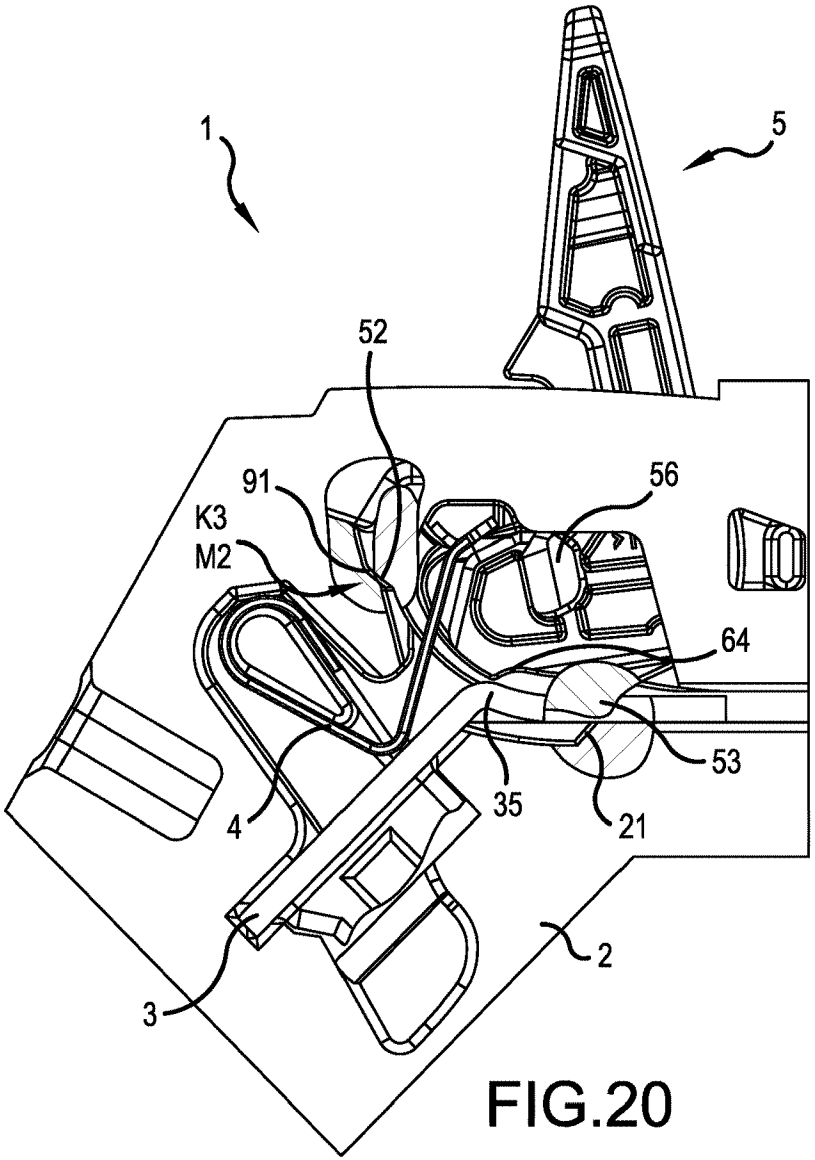

Based on the sequence of movements of the operating lever 5 illustrated by FIGS. 19 to 21, the advantageous force-reducing mechanism, which is effective at least when the operating lever 5 is moved from the open position towards the closed position, will now be explained. The operating lever 5 is supported at a main contact point K1, K2, K3, K4, K5 in the conductor connection terminal 1. Via the main contact point K1, K2, K3, K4, K5, the largest force of the clamping spring that acts on the operating lever is transmitted to at least one other element of the conductor connection terminal. The main contact point K1, K2, K3, K4, K5 can experience a discontinuous (abrupt) change of location several times when the operating lever 5 is pivoted over its pivoting range.

First of all, it is assumed that the operating lever 5 is completely in the open position and is supported on the first support point 84 and the second support point 85, as shown in FIG. 19. In this state, a first location of the main contact point K1 can be formed between the busbar 3 and the area of the operating lever 5 supported on the busbar 3, e.g. at the second support point 85. The first location of the main contact point K1 can alternatively also be formed at the first support point 84.

If the operating lever 5 is now subjected to force by the action of a manual operating force on the operating section 50 in the direction of the closed position, the pivoting process of the operating lever 5 begins with a first instantaneous center M1 of the pivoting movement being formed at the first support point 84, i.e. between the second latching edge 91 and the first fixing element 52. A second location of the main contact point K2 can now be formed at the first support point 84. At the same time, the latching at the second support point 85 is released, i.e. the operating lever 5 is slightly raised in this area so that the fourth fixing element 64 and its adjoining material areas are not stressed by friction on the busbar 3 and are accordingly not worn. As a result of this movement phase of the operating lever 5, the second fixing element 53 can concurrently be lifted over the first latching edge 21, so to speak, wherein a certain distance can arise between the second fixing element 53 and the first latching edge 21.

Figure 21:
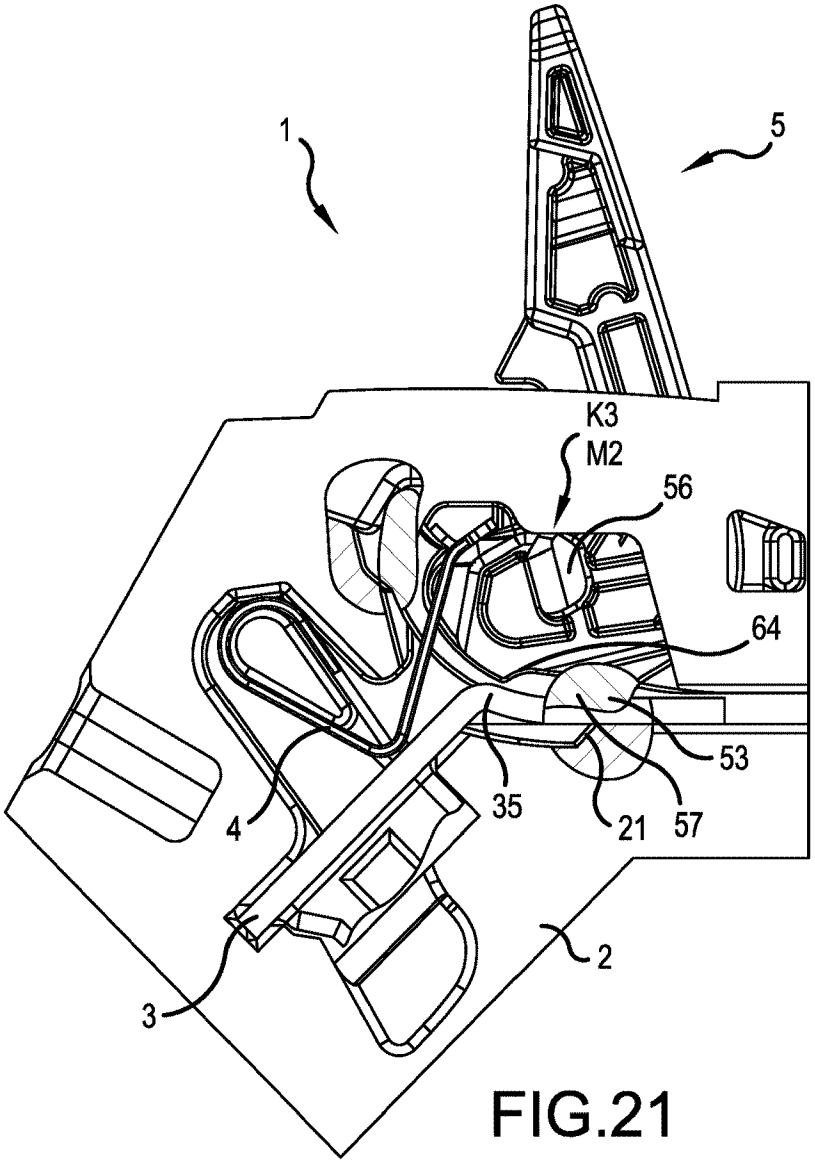
FIGS. 20-22 show the sequence of movements when moving the operating lever from the open position in the direction of the closed position and back.

FIG. 21 shows the further course of the movement of the operating lever 5 when it is moved into the closed position. If the operating lever 5 is moved further in the direction of the closed position, the lateral support element 56 of the operating lever 5 comes into contact with an edge of the insulating material housing 2. At this point in time, the instantaneous center of the pivoting movement of the operating lever 5 changes to point M2, as shown in FIG. 21, that is to say to the contact point between the lateral support element 56 and the insulating material housing 2. At this point, a third location of the main contact point K3 of the operating lever 5 can now be formed for a further movement phase of the operating lever 5.

The contact between the lateral support element 56 and the insulating material housing 2 is again broken. The operating lever 5 can now slide along a guide track of the insulating material housing with the second fixing element 53 or the underside of the first guide section 57, so that a fourth location of the main contact point of the operating lever 5 is now formed at this location.

Furthermore, in the further course of movement, the support projection 58 of the operating lever 5 comes into contact with the support area 34 of the busbar 3, so that a fifth location of the main contact point of the operating lever can be formed between the support area 58 of the operating lever 5 and the support area 34 of the busbar.

Figure 22:
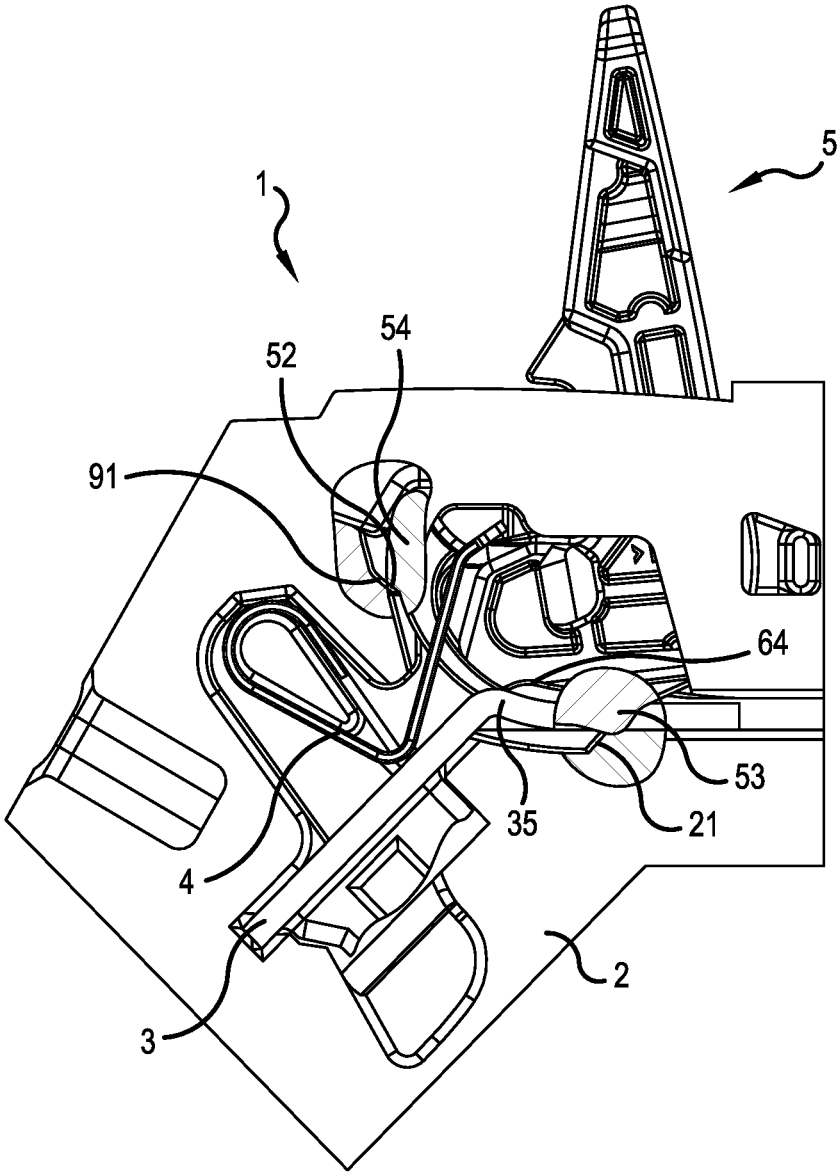

FIG. 22 now shows the position of the operating lever 5 when moving from the closed position into the open position, shortly before reaching the open position. The underside of the first guide section 57 or the second fixing element 53 slide along a guideway of the insulating material housing 2 or rest on this guideway shortly before reaching the open position, so that the fourth fixing element 64 and the support projection 58 of the operating lever 5 opposite the busbar 3 are lifted or at least slightly spaced. In the further course of movement of the operating lever 5 into the closed position, the second fixing element 53 moves behind the first latching edge 21 of the insulating material housing 2, so that the operating lever 5 is pulled under the action of the spring force in the direction of the busbar 3 and the fourth fixing element 64 rests on the bent area 35 (second support point 85) and thus reaches its end position in the open position according to FIG. 19.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal comprising:

an insulating material housing;

a busbar;

a clamping spring; and an operating lever which is received in the insulating material housing such that the operating lever is pivotable over a pivoting range, wherein the operating lever interacts with the clamping spring, wherein the busbar has a slot-shaped recess, a circumference of the slot-shaped recess being surrounded by a material of the busbar, and wherein a portion of the operating lever extends into, and is guided by, the slot-shaped recess.

2. A conductor connection terminal comprising:

an insulating material housing;

a busbar;

a clamping spring; and an operating lever which is received in the insulating material housing and is pivotable over a pivoting range, wherein the operating lever interacts with the clamping spring, wherein the busbar has a first busbar section at which a first clamping point of a first conductor connection of the conductor connection terminal is formed, and the busbar has a second busbar section, wherein the first busbar section is connected to the second busbar section via a bent area of the busbar in which the busbar is bent, wherein the busbar has a slot-shaped recess, a circumference of the slot-shaped recess being surrounded by a material of the busbar, and wherein a portion of the operating lever extends into, and is guided by, the slot-shaped recess.

3. The conductor connection terminal according to claim 2, wherein the operating lever is supported on the busbar at least over a portion of the pivoting range in the second busbar section.

4. The conductor connection terminal according to claim 2, wherein an area of the operating lever has a contour adapted to a curvature of the bent area of the busbar, wherein in an open position of the operating lever, the area of the operating lever rests on an upper side of the bent area and forms a fourth fixing element for fixing the operating lever on the busbar.

5. The conductor connection terminal according to claim 2, wherein an interior angle ranging from 105 to 165 degrees or 120 degrees to 150 degrees is formed between the first busbar section and the second busbar section via the bent area.

6. The conductor connection terminal according to claim 2, wherein the bent area forms a section which is raised in relation to regions of the busbar adjoining the bent area.

7. The conductor connection terminal according to claim 2, wherein the slot-shaped recess of the busbar is only arranged in the second busbar section or extends from the second busbar section into the bent area or extends from the second busbar section across the bent area into the first busbar section.

8. The conductor connection terminal according to claim 2, wherein the operating lever has a spring driver for actuating the clamping spring, wherein at least in a closed position of the operating lever, the spring driver is arranged in a region of the bent area of the busbar, and wherein in the closed position of the operating lever, the spring driver is not in engagement with the clamping spring.

9. The conductor connection terminal according to claim 2, wherein the conductor connection terminal has a second conductor connection for connecting a second electrical conductor, wherein the second conductor connection is electrically conductively connected via the second busbar section to the first conductor connection or can be connected via a connecting element.

10. The conductor connection terminal according to claim 2, wherein a free end of the first busbar section extends in a direction facing away from the operating lever.

11. The conductor connection terminal according to claim 2, wherein the portion of the operating lever that extends through, and is guided by, the slot-shaped recess is a curved guide section, wherein the curved guide section has support projections that project perpendicularly off each side of the curved guide section, such that while the curved guide section extends through the slot-shaped recess, the support projections are supported on an upper surface of the busbar.

12. The conductor connection terminal according to claim 2, wherein the bent area is designed such that the busbar, starting from the second busbar section, is initially bent concavely with a first radius and then merges into a convex bent area with a second radius.

13. The conductor connection terminal according to claim 12, wherein the bent area is designed such that the busbar merges directly from the first radius into the second radius without a non-bent portion interposed therebetween.

14. The conductor connection terminal according to claim 2, wherein the operating lever is pivotable between an open position and a closed position, and wherein the operating lever is not mounted on a fixed support axis, such that a center of rotation of the operating lever is displaceable over the pivoting range.

15. The conductor connection terminal according to claim 14, wherein, in the closed position, an outer surface of a manual operating section of the operating lever runs in a longitudinal direction of the operating lever essentially parallel to the second busbar section, which connects the first busbar section to a third busbar section or runs essentially parallel to the third busbar section.

16. The conductor connection terminal according to claim 2, wherein the clamping spring has a clamping leg.

17. The conductor connection terminal according to claim 16, wherein the clamping spring has a contact leg.

18. The conductor connection terminal according to claim 17, wherein the clamping spring has a spring arch adjoining the contact leg, and wherein the clamping leg adjoins the spring arch.

19. The conductor connection terminal according to claim 17, wherein the contact leg is supported on the busbar in the first busbar section.

20. The conductor connection terminal according to claim 16, wherein the clamping spring has an operating arm which projects from the clamping leg.

21. The conductor connection terminal according to 14, wherein in a closed position of the operating lever when no electrical conductor is clamped to the first clamping point, the operating arm initially runs along the first busbar section starting from the clamping leg and projects beyond the bent area.

22. The conductor connection terminal according to claim 20, wherein the clamping leg has a clamping tongue, and wherein the operating lever cooperates with the operating arm to move the clamping tongue.

23. The conductor connection terminal according to claim 22, wherein the busbar has a conductor lead-through opening into which the contact leg and the clamping tongue extend.

24. The conductor connection terminal according to claim 23, wherein the conductor lead-through opening has wall sections which protrude from the busbar plane on all sides and which form a material passage.

* * * * *